US006704533B2

(12) United States Patent
Isomura et al.

(10) Patent No.: US 6,704,533 B2
(45) Date of Patent: Mar. 9, 2004

(54) TONER SUPPLY CONTAINER AND STIRRING ROTATION MEMBER

(75) Inventors: Tetsuo Isomura, Toride (JP); Katsuya Murakami, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/004,876

(22) Filed: Dec. 7, 2001

(65) Prior Publication Data

US 2002/0071698 A1 Jun. 13, 2002

(30) Foreign Application Priority Data

Dec. 8, 2000 (JP) ..... 2000/373743

(51) Int. Cl.[7] ..... G03G 15/08

(52) U.S. Cl. ..... 399/254; 222/DIG. 1; 399/263

(58) Field of Search ..... 399/254, 256, 399/258, 263; 366/241, 244, 279; 222/DIG. 1, 167

(56) References Cited

U.S. PATENT DOCUMENTS 4,993,829 A * 2/1991 Naganuma et al. .... 222/DIG. 1
5,202,732 A * 4/1993 Yahata ..... 399/263
5,243,390 A * 9/1993 Takemoto et al. ..... 399/254
5,270,785 A * 12/1993 Kita et al. ..... 222/DIG. 1
5,835,828 A 11/1998 Jyoroku ..... 399/256
6,385,422 B1 * 5/2002 Ishiguro et al. ..... 399/258
6,418,290 B1 * 7/2002 Isomura et al. ..... 399/254
6,456,810 B1 * 9/2002 Deguchi et al. ..... 399/254

FOREIGN PATENT DOCUMENTS

JP 8-272200 10/1996
JP 9-62072 3/1997

OTHER PUBLICATIONS

U.S. patent application Ser. No. 09/697,715, filed Oct. 27, 2000, allowed.
U.S. patent application Ser. No. 09/900,944, filed Jul. 10, 2001, pending.

* cited by examiner

*Primary Examiner*—Sophia S. Chen
(74) *Attorney, Agent, or Firm*—Fitzpatrick, Cella, Harper & Scinto

(57) ABSTRACT

A developer supply container for supplying a developer into an image forming apparatus includes a developer container for accommodating a developer; a stirring member for stirring the developer in the developer container wherein the stirring member includes a flexible member, a supporting portion for supporting the flexible member, a rotation shaft, and a plurality or connecting portions for connecting the rotation shaft and the supporting position; wherein the supporting portion has a contact portion which is contacted to the flexible member when the flexible member flexes during its stirring operation and a non-contact portion which does not contact to the flexible member when the flexible member flexes during it stirring operation, between the connecting portions, the non-contact portion being adjacent the contact portion with respect to a direction of an axis of the rotational shaft.

13 Claims, 15 Drawing Sheets

TONER SUPPLY CONTAINER AND STIRRING ROTATION MEMBER

FIELD OF THE INVENTION AND RELATED ART

The present invention relates to a developer supply container for supporting developer to an image forming apparatus of an electrophotographic type or the like and a stirring member usable therewithin, more particularly to a developer supply container for supplying a developer to an image forming apparatus such as a copying machine, a printer, a facsimile machine or the like and a stirring member usable therewith.

In a conventional image forming apparatus such as a copying machine and a printer of an electrostatic type or an electrophotographic type, fine particle toner it used as a developer. When the toner in the main assembly of image forming apparatus is consumed, the toner is supplied into the main assembly of image forming apparatus using a toner supply container.

Generally, the toner supply container comprises a main container body of a cylindrical or rectangular parallelepiped shape, made of synthetic resin material or the like, a sealing member for sealing an opening for supplying the toner from the main body on the container into the developing device, a stirring rotation member and a feeding member for stirring and feeding the toner from the inner portion toward the opening of the container. A process cartridge is used in which the toner supply container is integral with a photosensitive drum, a cleaner, a charger and the like, the process cartridge being situated in the main assembly of the image forming apparatus in use.

Since the toner are very fine particles, that is a problem that toner is scattered during the toner supplying operation, with a result of contamination of the operator or the surroundings of the container. In consideration of this problem, there has been proposed a system in which the toner supply container is situated in the image forming apparatus similarly to the process cartridge, and the toner is discharged through the opening thereof.

Such a stationary type toner supply container may be provided with a stirring rotation member to prevent caking of the toner and to deliver the toner. The stirring rotation member is driven or rotated through engagement between a main assembly side driver through a coupling member extended out of an end of the toner supply container or by direct engagement.

In such a toner supply container provided with a stirring rotation member, if a rotational stirring torque is large, a relatively expensive high-power electric motor is required, and it is necessary to raise the strength of the stirring rotation member.

Accordingly, various proposals have been made to reduce the rotational stirring torque. For example, Japanese Laid-open Patent Application Hei 8-272200 discloses a system in which a stirring rod of the stirring rotation member is rotatably supported by a spring, and when a load exceeding the elastic force of the spring acts on the stirring rod, the stirring rod flexes, by which the radius of rotation is shortened, and therefore, the rotational stirring torque is decreased. Japanese Laid-open Patent Application Hei 9-062072 discloses a system in which the rotational stirring torque is decreased by disposing three or more stirring blades of the stirring rotation member are disposed at the different angular positions.

However, such conventional systems involved the following problems. When the spring is need as with Japanese Laid-open Patent Application Hei 8-272200, the number of parts and number of assembling steps increase with the result of cost increase. When three or more stirring employees are disposed at different angular positions, the moldability and the assembling easiness property of the stirring blades are not good.

Therefore, there is a demand for a stirring rotation member in which the number of parts is a small, the moldability and the assembling easiness property are good, and the rotational stirring torque is small.

It is pointed out that if the strength of the stirring rotational member is made lower, the rotational stirring torque decreases because of the increased twisting flexibility of the rotational stirring blade, but the stirring effects also decreases with the result of remarkable increase of the bulk density after transportation of the toner supply container. It is desired that toner can be stably stirred with stability even in such a case.

SUMMARY OF THE INVENTION

Accordingly, it is a principal of officer of the present intention to provide a developer supply container with which the stirring torque can be reduced without deteriorating the strength of the stirring member. Accordingly, it is a principal object of the present invention to provide a stirring member with which the stirring torque can be reduced without deteriorating the strength of the stirring member.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

<Embodiment 1>

Figure 1:
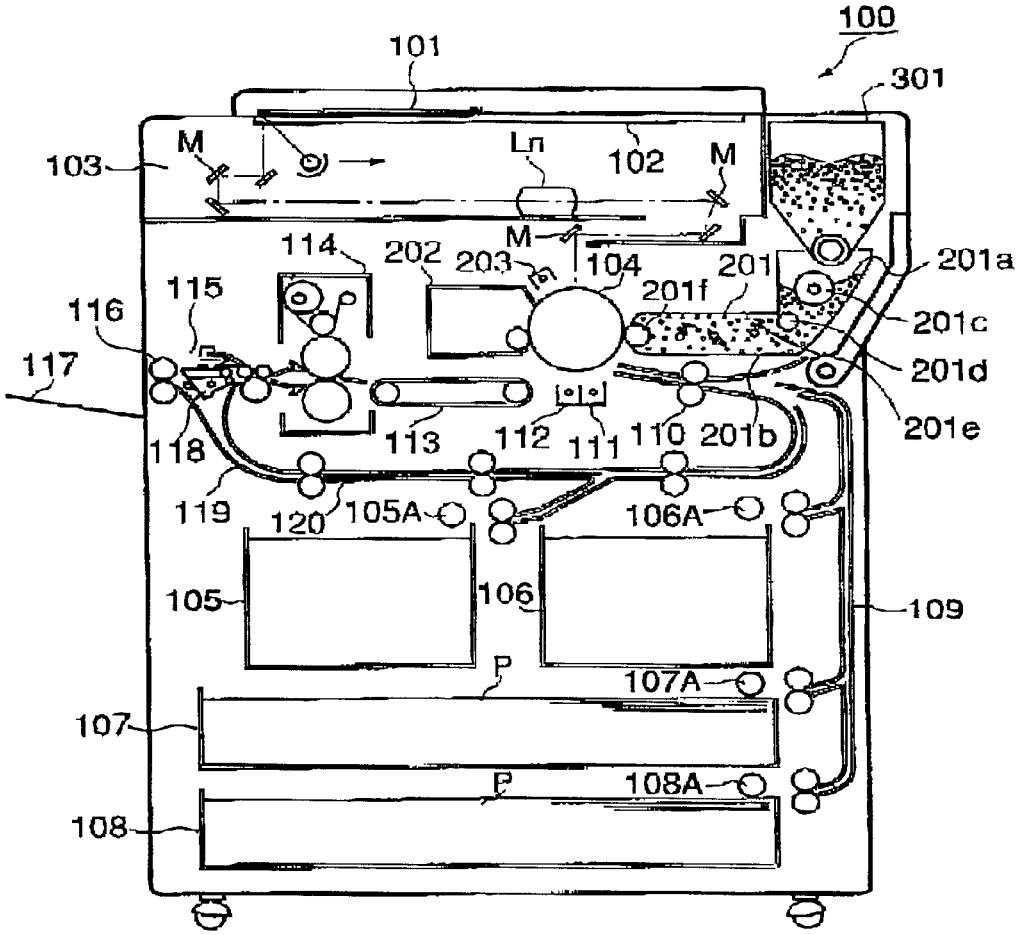
FIG. 1 is a sectional view of an electrophotographic copying machine which is an example of an electrophotographic image forming apparatus into which a toner supply container according to the present invention is mounted.

Referring to FIG. 1, the description will first be made as to an electrophotographic copying machine which is an example of an electrophotographic image forming apparatus to which a toner supply container according to an embodiment of the present invention is mounted.

FIG. 1 is a sectional view of an electrophotographic copying machine, in which reference numeral 100 designates a main assembly of the electrophotographic copying machine which will be called hereinafter "main assembly of the apparatus", 101 is an original document, which is placed on an original supporting platen glass 102. A light image is formed on an electrophotographic photosensitive drum 104 in accordance with image information by a plurality of mirrors M and a lens Ln of an optical portion 103, and an electrostatic latent image is formed on the photosensitive drum 104.

Designated by 105–108 are cassettes, one of which is selected, depending on sheet size information of the cassettes 105–108, on the basis of information inputted by the operator on an operating portion 100*a* (FIG. 2) or automatically on the basis of the paper size of the original 101, to feed the selected or proper recording material P out. Here, the recording material is not limited to paper but may be an OHP sheet.

The sheet P is singled out and is fed to registration rollers 110: a feeding portion 109 by a sheet feeding and separating devices 105A–108A so as to feed the sheet P in synchronism with the rotation of the photosensitive drum 104 and the scanning timing of the optical portion 103. Designated by 111 is a transfer discharger, and 112 is a separation discharger. The toner image formed on the photosensitive drum 104 is transferred onto the sheet P by a transfer discharger 111.

The sheet P on which the toner image has been transferred, is separated from the photosensitive drum 104 by a separation discharger 112.

The sheet P is fed by a feeding portion 113 to an image fixing portion 114, in which the toner image is fixed an the street P by heat and pressure. When one sided copy mode is selected, the sheet passes through a sheet discharge reversion portion 115 and is discharged onto a sheet discharge tray 117 by sheet discharging rollers 116. If a duplex copy is selected, the sheet is refed to the registration rollers 110 through a refeeding passage 119 and 120 under the control of a flapper 118 at a sheet discharge reversion portion 115.

When a superimposed copy mode is selected, a part of the sheet P is temporarily discharged to an outside of apparatus by the sheet discharging rollers 116 through the sheet discharge reversion portion 115. Thereafter, at the time when the trailing end of the sheet P has passed through the flapper 118 and is still nipped by the sheet discharging rollers 116, the flapper 118 is controlled, and the sheet discharging rollers 116 are rotated in the opposite direction to refeed the sheet P into the main assembly 100 of the apparatus. Thereafter, the sheet P is fed to the registration rollers 110 through the sheet refeeding portion 119, 120, and then fed in the same manner as with the one-sided copy mode onto the sheet discharge tray 117.

In the main assembly 100 of the apparatus having such structures, there are a developing station 201, a cleaning station 200 and a primary charger 203 and the like around the photosensitive drum 104. The developing station 201 functions to develop the electrostatic latent image formed on the photosensitive drum 104 in accordance with the information of the original 101 by the optical portion 103, with toner. A toner supply container 301 for supplying the toner to the developing station 201 is provided in the main assembly 100 of apparatus, the toner supply container 301 being detachably mountable by the user. The developing station 201 includes a toner hopper 201*a* and a developing device 201*b*.

The toner hopper 201*a* is provided with a stirring member 201*c* for stirring the toner supplied from the toner supply container 301, and the toner stirred by the stirring member 201*c* is fed to the developing device 201*b* by a magnet roller 201*d*. The developing device 201*b* includes a developing roller 201*f* and a feeding member 201*e*. The toner fed from tho toner hopper 201*a* by the magnet roller 201*d* is fed to the developing roller 201*f* by the feeding member 201*e*, and is supplied to the photosensitive drum 104 by the developing roller 201*f*.

The cleaner station 202 functions to remove the toner remaining on the photosensitive drum 104, and primary charger 203 functions to electrically charge the photosensitive drum 104.

Figure 2:
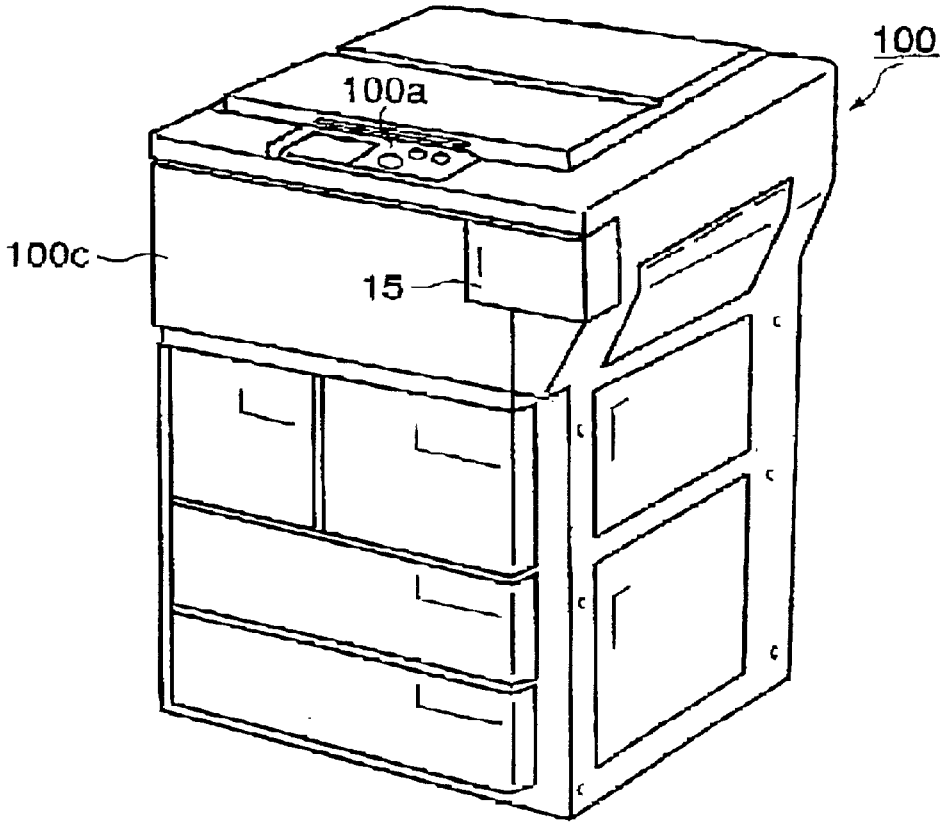
FIG. 2 is a perspective view of an electrophotographic copying machine.
Figure 3:
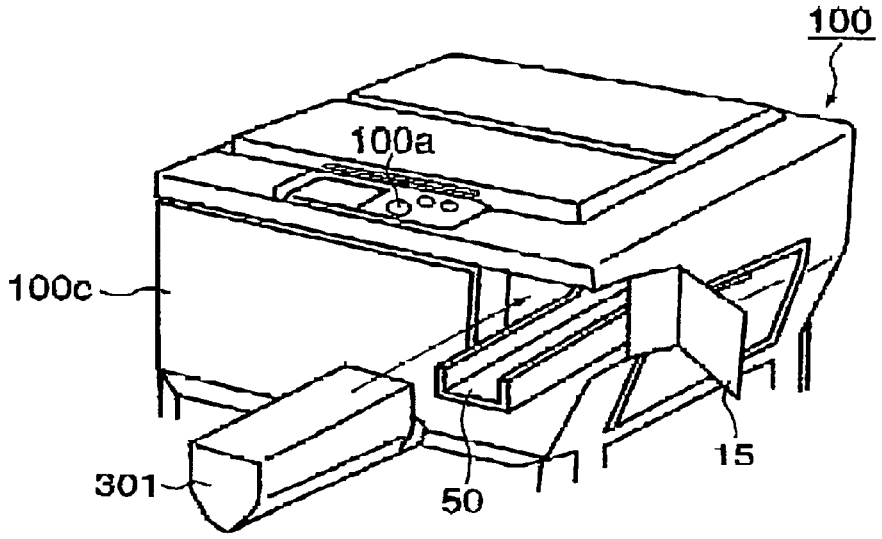
FIG. 3 is a perspective view illustrating mounting of the toner supply container into the electrophotographic copying machine with an exchange cover of the electrophotographic copying machine in an open position.

When the user opens, as shown in FIG. 3, the toner supply container exchange cover 15 which is a part of the outer casing as shown in FIG. 2, a container supporting tray 50 is drawn out to a predetermined position by an unshown driving system. Then, the toner supply container 301 is placed on the tray 50. When the user removes the toner supply container 301 from the main assembly of apparatus, the toner supply container 301 on the open tray 50 is taken out. The cover 15 is opened and closed only for the purpose of mounting and demounting of the toner supply container 301. In the ease of the maintenance operation, the front cover 100*c* is opened.

The toner supply container 301 may be directly set into the main assembly 100 of the apparatus, or may be directly taken out of the main assembly 100 of the apparatus.

(General Arrangement of Toner Supply Container)

The description will be made as to the toner supply container 301 according to this embodiment of the present invention.

Figure 4A:
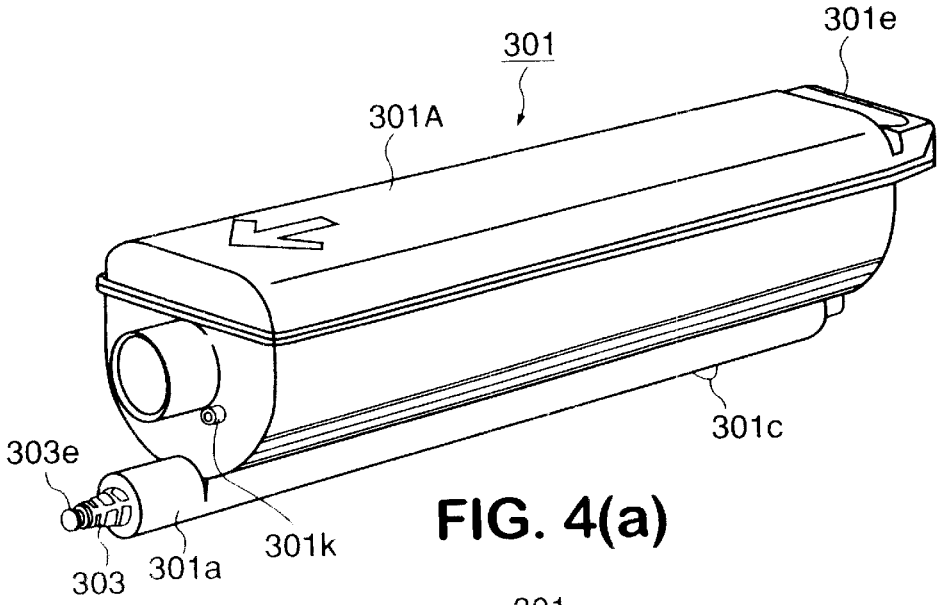
FIGS. 4(*a*) and 4(*b*) are perspective views of a toner supply container according to a first Embodiment 1 of the present invention as seen from the side provided with a supply opening shown in FIG. 4(*a*) and a perspective view of the same as seen from the side provided with a grip as shown in FIG. 4(*b*).
Figure 4B:
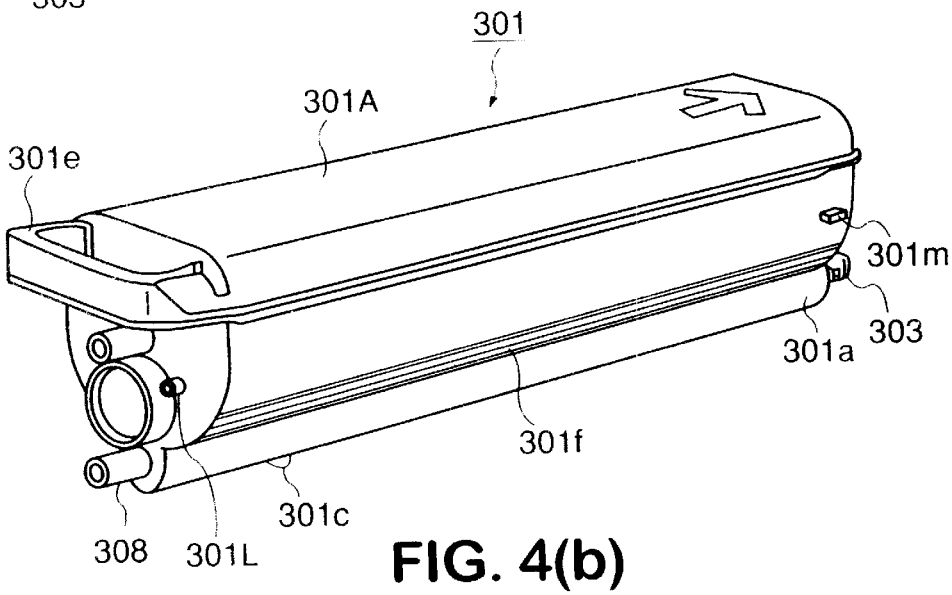
Figure 5:
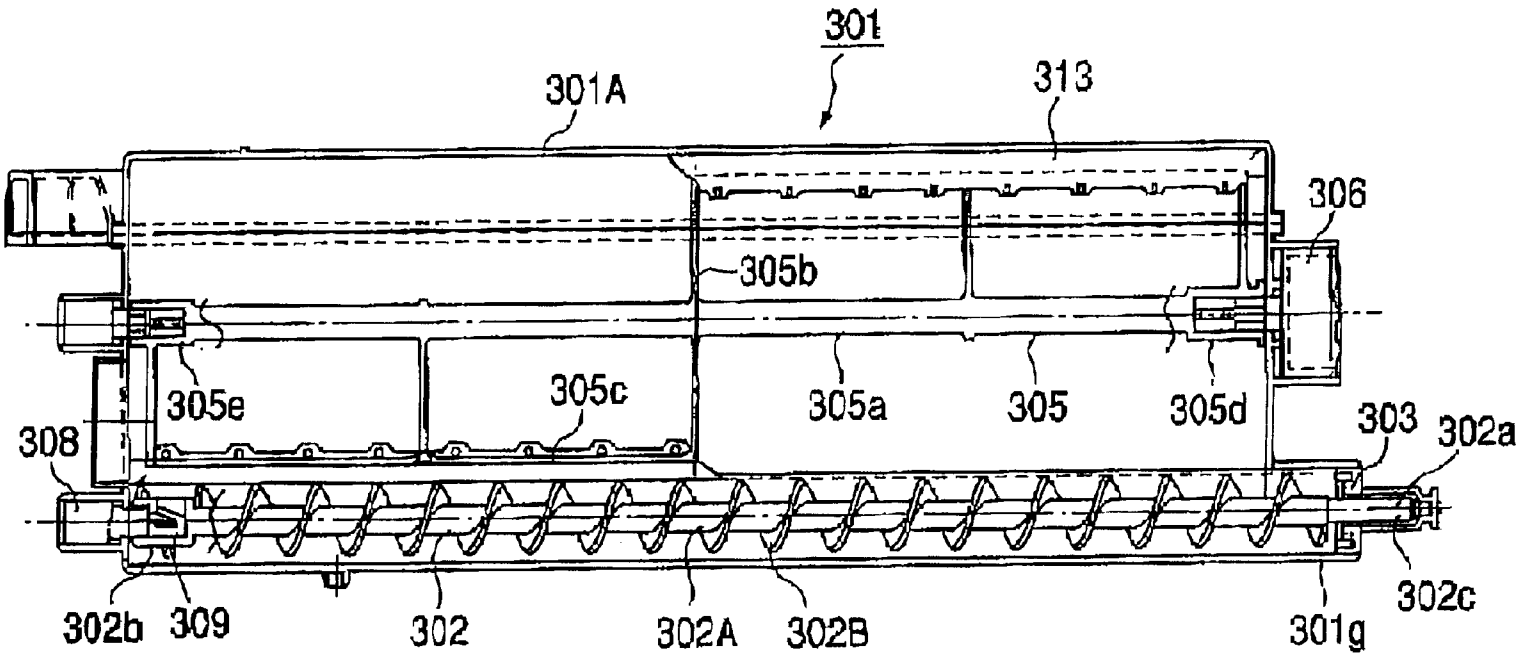
FIG. 5 is a front sectional view of a toner supply container according to Embodiment 1 of the present invention.

FIG. 4 is a perspective view of a toner supply container 301 according to an embodiment of the present invention, and FIG. 5 as a front sectional view of a toner supply container 301.

In FIGS. 4 and 5, designated by 301A is a main body of the container, 302 is a feeding member for feeding the toner toward a toner supply opening 301*a*, and 303 is a sealing member for sealing the toner supply opening. Reference numeral 305 designates a stirring member for stirring the toner in the main body 301A of the container; 306 is a coupling member for transmitting a rotational driving force to the stirring member 305 from the image forming apparatus through engagement with the stirring member 305; 309 in an oil seal for preventing toner leakage.

Figure 6A:
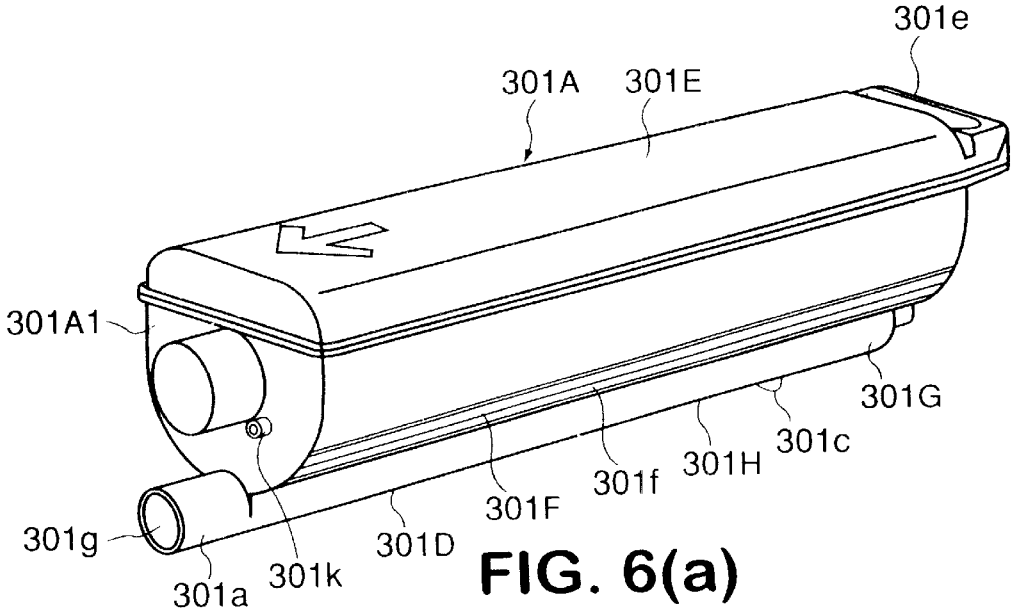
FIGS. 6(*a*) and 6(*b*) are perspective views of a toner supply container according to a first Embodiment 1 of the present invention as seen from the side provided with a supply opening as shown in FIG. 6(*a*) and a perspective view of the same as seen from the side provided with a grip as shown in FIG. 6(*b*).
Figure 6B:
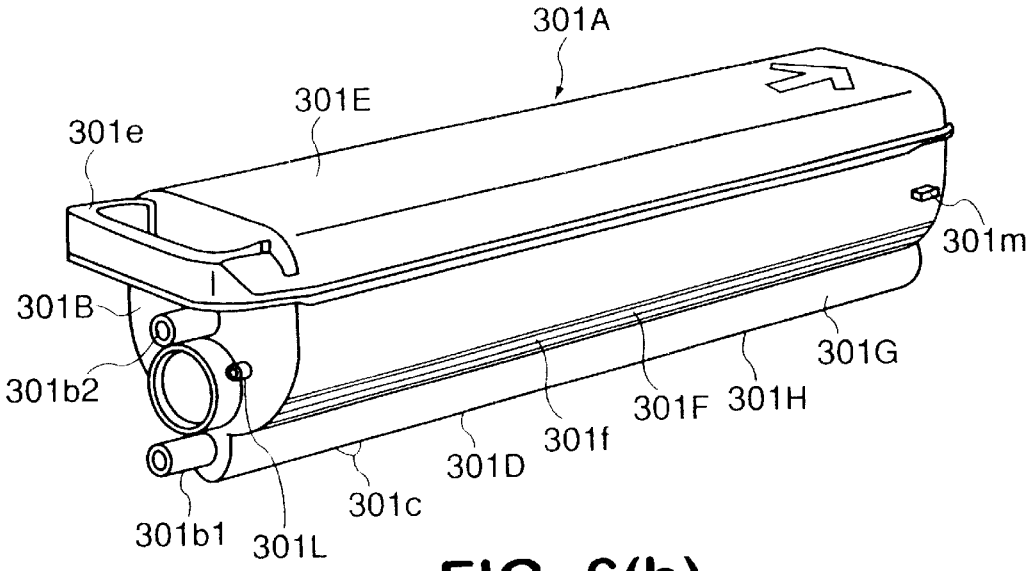
Figures 7A, 7B, 7C, 7D, 7E, 7F:
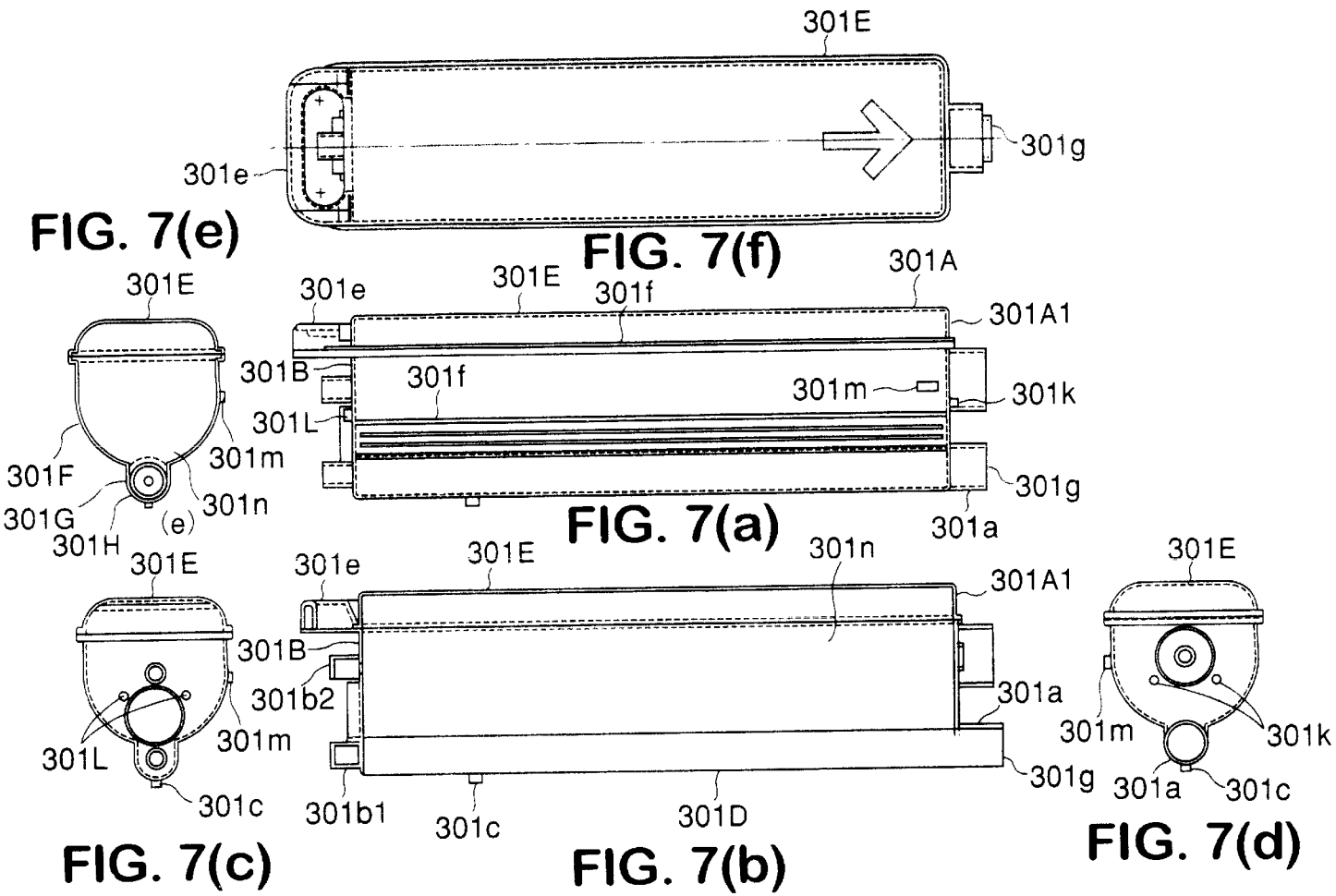
FIG. 7(*a*) is a front view of a toner supply container according to Embodiment 1 of the present invention, FIG. 7(*b*) is a sectional view of the same, FIG. 7(*c*) is a left side view of the same, FIG. 7(*d*) is a right side view of the same, FIG. 7(*e*) is a sectional side view of the same, and FIG. 7(*f*) is a top plan view of the same.
Figure 8A:
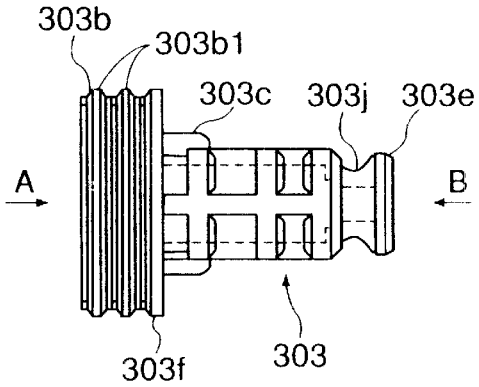
FIG. 8(*a*) is a front view of a sealing member, FIG. 8(*b*) is a view of the same as seen in a direction A shown in FIG. 8(*a*), FIG. 8(*c*) is a view of the same as seen in a direction B shown in FIG. 8(*a*), and FIG. 8(*d*) is a front sectional view of the same.
Figure 8B:
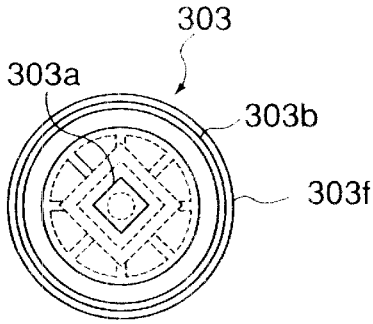
Figure 8C:
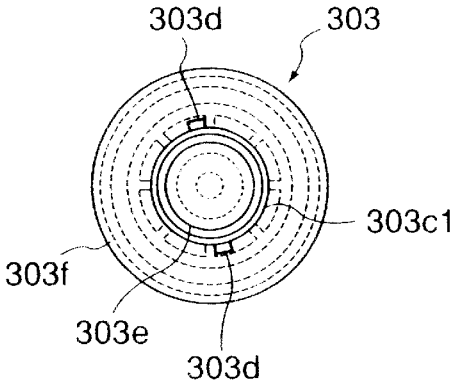
Figure 8D:
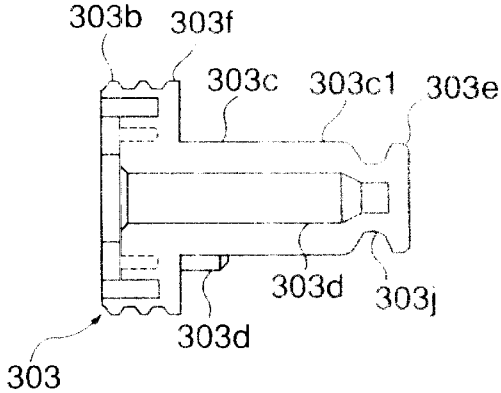

Referring to FIGS. 6 and 7, the main body 301A of the toner supply container will be described FIG. 6 is a prospective view of a main body 301A of the container; FIG. 7 is a front view of a main body 301A of the container (a), a sectional view thereof (b), a left-hand side view (c), a right-hand side view (d) and a sectional side elevation (e).

The main body 301A of the toner supply container comprises a curved portion 301F having a width which decreases toward the bottom, a linear portion 301G having a substantially constant width provided at the bottom of the curved portion 301F, and a substantially semicircle portion 301H provided at the bottom of the linear portion 301G.

It is preferable that main body 301A of the container is produced through an injection molding, a blow molding and an injection blow molding or the like from a plastic resin material resin material or the like, but may be produced from another material through another method. It is preferable that main body 301A of the container is divided into two or more parts, which are united by welding, bonding or the like.

The lower portion of a side surface 301A of the main body 301A of the container is provided with a cylindrical toner supply opening 301*a*, projected therefrom, for supply the toner from the toner accommodating portion 301*n* into the main assembly 100 of the apparatus. One end portion of the toner supply opening 301*a* is provided with a toner supply opening 301*g*. The other side surface 301B of the main body 301A of the container is provided with a first receiving portion 301*b*1. For rotatably supporting a feeding member 302 at a position corresponding to the toner supply opening 301*a*. The outside of the bottom surface 301D is provided with a positioning portion 301*c* which is to be positioned by the main assembly 100 of the apparatus when the toner supply container 301 is mounted to the main assembly 100 of the apparatus. The positioning portion 301*c* is engaged with an opening and closing means for the toner supply opening provided in the main assembly 100 of the apparatus to move the toner supply container 301 in the mounting-and-demounting direction. In this embodiment, the engaging portion 301*c* is in the form of a dowel projected outwardly from the lower surface 301D.

The upper surface 301E of the main body 301A of the container is provided with grip 301*e* which it gripped by the user when the toner supply container 301 is mounted to or demounted from the main assembly 100 of the apparatus. A lower inclined surface (curved portion) at each of the front side and rear surface in provided wit a groove 301*f* extended substantially parallel with the longitudinal direction of the toner supply container 301 to facilitate handling of the main body 301A of the container when the toner supply container 301 is mounted to the main assembly 100 of the apparatus.

Above a first receiving portion 301*b*1 of the other side surface 301B of the main body 301*b*1 of the container, there is provided a second receiving portion 301*b*2 for rotatably supporting the stirring member 305.

The toner supply opening 301*a* is disposed in a side surface 301A1 which is opposite from the side surface 301B provided with the grip 301*e* with respect to the longitudinal direction of the main body 301A of the container. Therefore, the user is prevented from contacting unintentionally the toner supply opening 301*a* when the toner supply container 301 is mounted to the main assembly 100 of the apparatus. The toner supply opening 301*a* is provided at a lower portion of the side surface 301A1, therefore, the toner can be efficiently delivered even when the common of the toner remaining in the main body 301A of the container becomes small.

Here, the toner supply opening 301*a* is cylindrical, and height thereof is 27.8 mm, and an outer diameter of the cylindrical portion thereof is approx. 27.6 mm, in this embodiment.

The outside of the lower surface 301D of the main body 301A of the container is provided with an engaging portion 301*c* which is correctly position by a locking portion provided in the main assembly 100 of the apparatus when the toner supply container 301 is mounted to the main assembly 100 of the apparatus. The engaging portion 301*c* is in the form of a projection of circular column shape projected outwardly from the lower surface 301D as described hereinbefore, and an outer diameter of the circular column shape portion is approx. 8 mm in this embodiment.

The engaging portion 301*c* functioning as the partitioning portion is disposed at a position 2 mm–8 mm from the lower surface 301D and approx. 71 mm from a side end surface 301B opposite from the side having to toner supply opening 301*a* with respect to the longitudinal direction of the lower surface 301D.

The engaging portion (positioning portion) 301*c* preferably has a circular column shape, but is may be of a prism shape, a semicircular shape, or the like. On the side surface 301A1 and the other side surface 301B are each provided with two bosses 301*k*, 301L and boss 301*k*, 301L for positioning the main body 301A of the container when the dimensional inspection is carried out for the main body 301A of the container before factory shipment.

Designated by 301*m* is a rib for preventing erroneous mounting prevention. The rib 301*m* position is different if the toner supply container 301 is different, so that user is prevented from erroneously mounting different types of containers into the main assembly 100 of the apparatus.

It is preferable that main body 301A of the container is produced through an injection molding, a blow molding and an injection blow molding or the like from a plastic resin material resin material or the like, but may be produced from another material through another method. It is preferable that main body 301A of the container is divided into two or more parts, which are united by welding, bonding or the In this embodiment, two frames, namely, an injection molded upper frame and an injection molding lower frame of high impact polystyrene are welded with each other through vibration welding.

As shown in FIG. 5, the feeding member 302 comprises a shaft portion 302A and a feeding blade 302B provided on the shaft portion 302A. The feeding blade 302B functions as a feeding portion for feeding the powdery toner in the predetermined direction by rotation of the shaft portion 302A. It Includes a high rigidity helical blades. The feeding member 302 is mounted to the main body 301A of the container such that axis of the shaft portion 302A is substantially aligned with the center of the substantially circular toner supply opening 301*g*.

The feeding member 302 is not limited to that of a so-called screw type described in this embodiment, but may be another type, for example, it may comprises a shaft portion 302A and a flexible blade. The shaft portion 302A and the feeding blade 302B may be integrally molded, or they may be separate members. In this embodiment, the shaft portion 302A and the feeding blade 302B are an integrally molded plastic resin.

The feeding member 302 is provided with an extended portion 302*c* inside the cylindrical portion of the toner supply opening 301*a*. In this embodiment, the extended portion 302*c* is protected out of the toner supply opening 301*a,* and a free end portion of the outward extended portion of the extended portion 302*c* functions to receive a rotational driving force from the main assembly 100 of the apparatus. For this reason, a sealing member 303 which is movable in the axial direction is mounted at the free end portion of the feeding member 302.

An end portion (driving force receiving portion) of the extended portion 302*c* of the feeding member 302 has such a configuration (a polygonal shape, more particularly a rectangular configuration) suitable for receiving the rotational driving force from the main assembly 100 of apparatus through a sealing member 303.

One end portion of the shaft portion 302A is supported to the sealing member 303 through one end portion 302*a* of the extended portion 302*c*. The other end portion 302*b* of the shaft portion 302A is rotatably supported by a first bearing member 308, so that when the main body 301A of the container is unsealed or opened, the shaft portion 302A is rotatably supported by the first bearing member 308.

One end portion of the shaft portion 302A is supported to the sealing member 303 through one end portion 302*a* of the extended portion 302C. The other end portion 302*b* of the shaft portion 302A is rotatably supported by a first bearing member 308, so that when the main body 301A of the container is unsealed or opened, the shaft portion 302A is rotatably supported by the first bearing or 308.

The feeding member 302 is supported by a sealing member 303 without contact to an inner wall surface of the toner supply opening 301*a* and that shaft portion 302A is substantially horizontal with the inner wall surface of the toner supply opening 301*a*. By supporting the feeding member 302 in this manner, the toner can be fed substantially in a horizontal direction toward the toner supply opening when the feeding member 302 is rotated.

Referring to FIG. 8, the description will be made as to the sealing member 303. FIG. 8 is a front view of the sealing member 303 thereof (a), a view thereof as seen in a direction A (b), a view thereof as seen in a direction B, and a front sectional view thereof (d).

In FIG. 8, designated by 303D is a sealing portion which unsealably seals the toner supply opening 301*g* of the toner supply container 301 and is provided at a side of the sealing member 303 opposed to the toner supply container 301. The sealing portion 303*b* has an outer diameter which is larger than an inner diameter or the 301*g* by a proper degree. An engaging portion 303*b*1 of the sealing portion 303*b* is press-fitted into the toner supply opening 301*a* through the toner supply opening 301*g*, so that sealing member 303 seals the toner supply opening 301*g*.

Designated by 302*c* is a coupling engaging portion functioning as a driving force receiving portion (driver) for receiving a driving force for rotating the feeding member 302 from the main assembly 100 of the apparatus when the toner supply container 301 is mounted to the main assembly 100 of the apparatus. The coupling engaging portion 303*c* is provided with a projected portion 303*c*1 extended from the sealing portion 303*b* substantially coaxially with the shaft portion 302A of the feeding member 302 away from the main body 301A of tie toner container when the sealing member 303 is mounted to the main body 301A of the container. The coupling engaging portion 303*c* is provided on the peripheral surface of the projected portion 303*c*1, and is provided with a elongated projection (rib) 303*d* (in the form of a spline) which functions as a driving force receiving portion engageable with the coupling member 306. In this embodiment, spline projection 303*d* is provided at each of two equidistant positions. More particularly, they are at diametrically opposite positions (approximately 180° away from each other). The rib 303*d* is approx. 1.8 mm away from the outer periphery of the sealing member 303, and the projected portion 303*c*1 has an outer diameter of approx. 12 mm.

The sealing member 303 is provided with an engaging hole 303*a* functioning as a driving force transmitting portion for transmitting to the feeding member 302 the driving force received from the main assembly 100 of the apparatus for engagement with the one end portion 302*a* of the feeding member 302. The engaging hole 303*a* is in the form of an opening (hollow portion) formed through the sealing portion 303*b* and the coupling engaging portion 303*c*. The engaging hole 303*a* has a rectangular cross-section corresponding to the rectangular configuration of the end 302*a* of the shaft of the feeding member 302 projected through the toner supply opening 301*a*, and is slightly larger than the end 302*a* of the shaft so that end 302*a* is loosely fitted with the engaging hole 303*a*.

By the loose fitting of the shaft end 302*a* with the engaging hole 303*a*, the relative axial movement between the feeding member 302 and the sealing member 303 is permitted while relative rotation therebetween is prevented. By doing so, the sealing member 303 is separable from the main body 301A of the container, and therefore, the toner supply opening 301*g* can be unsealed (opened) upon the mounting of the toner supply container 301.

The length through which the engaging hole 303*a* and the shaft end 302*a* are engaged with each other, is enough such that engagement therebetween is maintained when the sealing member 303 is moved apart from the main body 301A of the container. Therefor, even if the sealing member 303 is separated from the main body 301A of the container, the feeding member 302 can receive the driving force through the sealing member 303 (coupling engaging portion 303*c*).

In addition, between the coupling engaging portion 303*c* and sealing portion 303*b*, there is provided a flange portion 303*f* which is abutted to an end of the toner supply opening 301*a* when the sealing portion 303*b* is press-fitted into the toner supply opening 301*a*. The flange portion 303*f* has an outer diameter which is substantially the same as the outer diameter of the, toner supply opening 301*a* (preferably, smaller than the outer diameter of the toner supply opening 301*a*), and therefore, the sealing portion 303*b* is press-fitted into the toner supply opening 301*a* by the flange portion 303*f* by the amount corresponding to the length of the sealing portion 303*b*.

On the other hand, designated by 303*e* is a locking projection which if formed at a free end of the coupling engaging portion 303*c* and which constitutes a locking portion engageable with a locking member provided in the main assembly 100 of apparatus. By engagement of the locking member of the main assembly side with the locking projection 303*e*, the sealing member 303 can be fixed when the toner supply opening 301*g* is opened.

It is preferable that sealing member 303 of such a structure is manufactured through injection molding of plastic resin material or like, but another material and manufacturing method are usable. For example, a plurality of members are connected. Since the sealing member 303 is press-fitted into the toner supply portion 301*a*, it is required to have a proper elasticity. The best material is low density polyethylene, and another preferable material next to the low density polyethylene includes polypropylene, Nylon, high density polyethylene and the like.

Designated by 303*j* is a locking groove engageable with a locking member provided in the main assembly 100 of apparatus.

As described in the foregoing, the sealing member 303 includes a substantially cylindrical engaging portion 303*b*1 engageable with the toner supply opening 301*a* and a flange portion 303*f* disposed substantially coaxially with the engaging portion 303*b*1. It further comprises a projected portion 303*c*1 substantially coaxially with the engaging portion 303*b*1 at a position across the portion 303*f* from the engaging portion 303*b*1, and the base portion thereof has a driving receiving portion 303*d*.

The leading end portion of the projected portion 303*c*1 with respect to the projecting direction is provided with a locking groove 303*j* and a locking projection 303*e*. A hollow portion extends from the engaging portion 303*b*1 ride toward the locking projection 303*e*, and a driving force transmitting portion is provided in the hollow portion. The looking projection 303*e* side of the hollow portion is not open, and therefore, the toner having entered the hollow portion does not leak to the outside of the toner supply container 301 when the engaging portion 303*b*1 is engaged with the toner supply opening 301*a*. Accordingly, the toner supply opening 301*a* is sealed by mounting the sealing member 303.

Thus, the sealing member 303 performs the following four functions:

(1) sealing the toner supply opening 301*a;*

(2) receiving the rotational driving force from the main assembly 100 of the apparatus, (3) transmitting the rotational driving force to the feeding member 302; and (4) engaging with the engageable member provided in the main assembly 100 of the apparatus for opening and closing the toner supply opening 301*a*.

Thus, the sealing member 303 is capable of transmitting the driving force from the main assembly 100 of the apparatus through the extended portion 302*c* to the shaft portion 302A to rotate the feeding member 302.

Figures 9A, 9B, 9C, 9D, 9E:
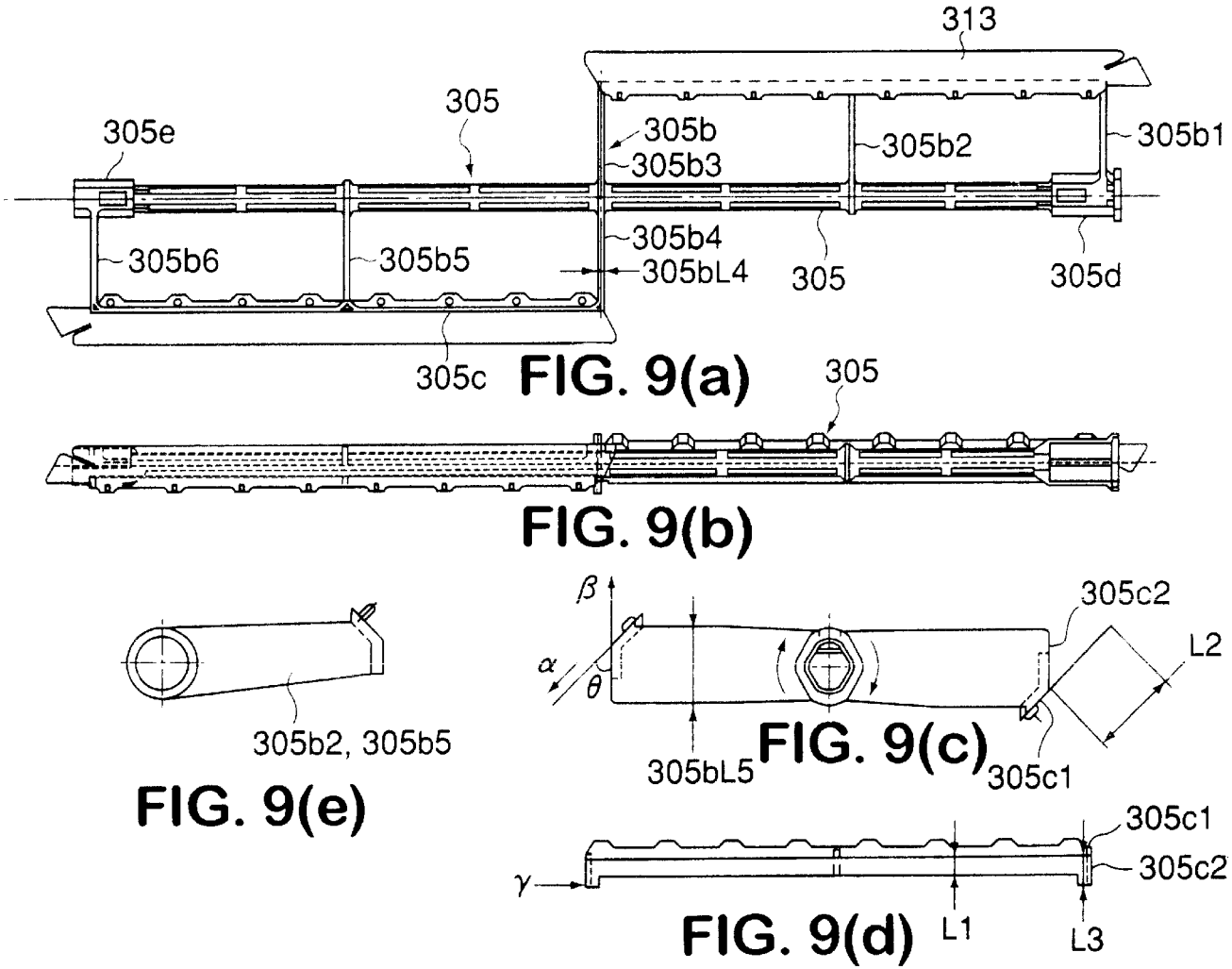
FIG. 9(*a*) is a front view of a stirring rotation member according to Embodiment 1 of the present invention, FIG. 9(*b*) is a top plan view of the same, FIG. 9(*c*) is a side view of the same, FIG. 9(*d*) is a top plan view of a horizontal portion of the same, FIG. 9(*e*) is a side view of a supporting arm of the same.
Figure 10:
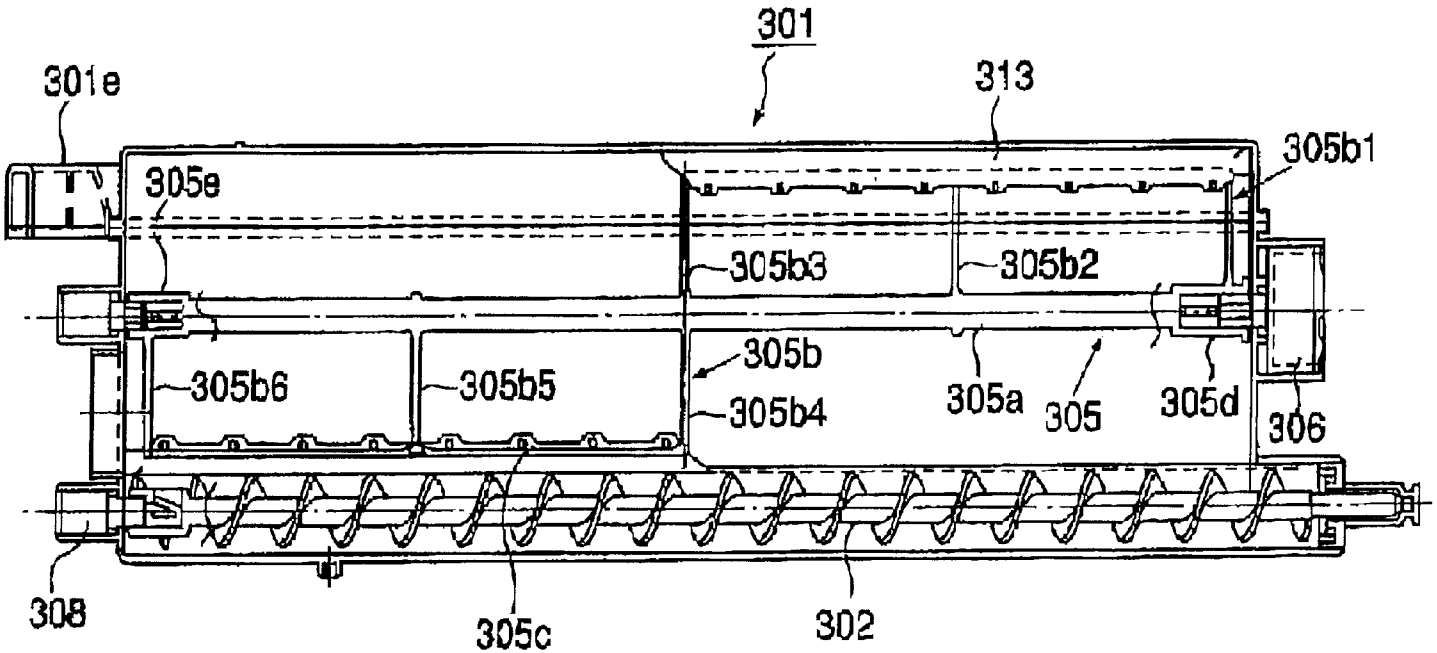
FIG. 10 is a front sectional view of a toner supply container provided with a stirring rotation member according to Embodiment 1 of the present invention.
Figure 11A:
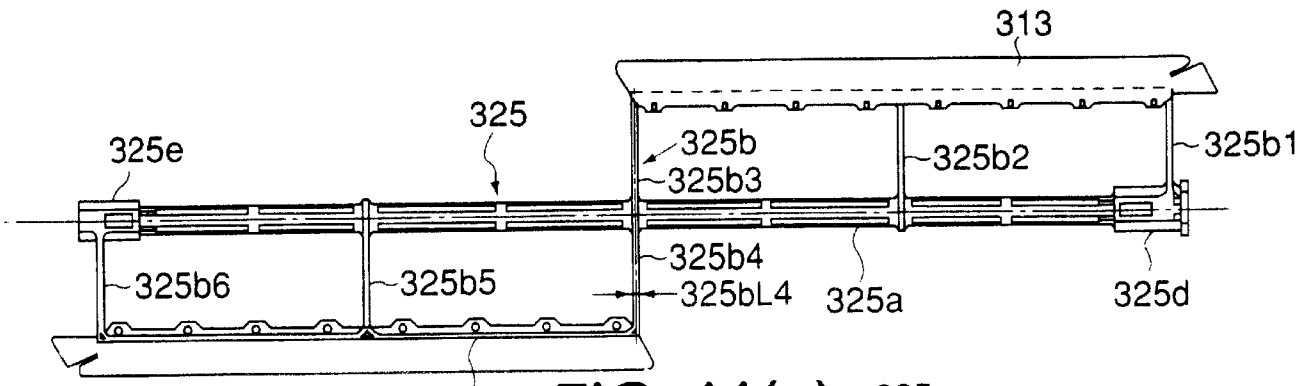
FIG. 11(*a*) is a front view of a stirring rotation member according to Embodiment 2 of the present invention, FIG. 11(*b*) is a top plan view of the same, FIG. 11(*c*) is a side view of the same, FIG. 11(*d*) a top plan view of a horizontal portion of the same, and FIG. 11(*e*) and a side view of a supporting arm of the same.
Figure 11B:
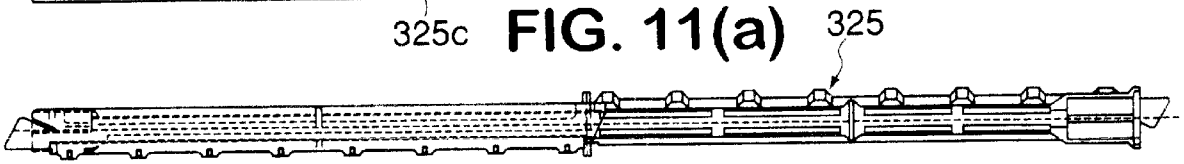
Figure 11C:
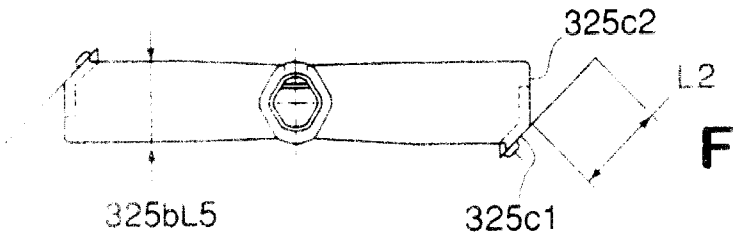
Figure 11D:
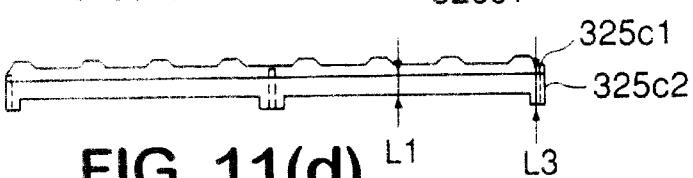
Figure 11E:
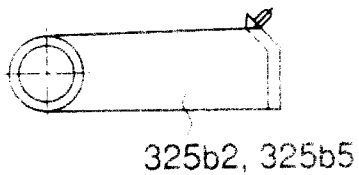

Referring to FIGS. 9 and 10, the description will be made as to the stirring rotation member 305 for stirring toner by its rotation. FIG. 9 is a front view of the stirring rotation member 305 (a), and a top plan view thereof (b), a side view thereof (c) a top plan view of a horizontal portion 305*c*2 (d) side views of supporting arms, 305*b*2, 305*b*5 (e); FIG. 10 is a front rotational view of a toner supply container 301 provided with a stirring rotation member 305.

As shown in FIG. 10, the stirring rotation member 305 includes a rotation shaft portion 305*a* (stirring shaft) supporting arms 305*b* (connecting portion), bridging portions 305*c* (supporting portion) and flexible members 313 which flexes during the stirring operation inwardly toward downstream. The rotation shaft portion 305*a*, the supporting arms 305*b* and the bridging portion 305*c* are produced through injection molding from a plastic resin material having a relatively high rigidity, whereas the flexible member 313 has a relatively low rigidity material (for example, plastic resin material film or sheet, an elastomer sheet or the like). In this embodiment, the flexible member 313 is made of a polyester sheet.

It is preferable that rotation shaft portion 305*a*, the supporting arms 305*b* and the bridging portion 305*c* are preferably produced integrally from a relatively high rigidity plastic resin material through an injection molding, but may be produced by connecting a plurality of parts by welding, bonding or the like into an integral member.

In the embodiment, the use is made with an ABS resin material which is integrally molded through an injection molding.

The description will be made as to the configurations of the rotation shaft portion 305*a*. The supporting arm 305*b* and the bridging portion 305*c* according to one of the features of the present invention.

The rotation shaft portion 305*a* and the rotation shaft portion 305*a* are each in the form of a rod having a diameter of 9 mm, and one end 305*d* of the rotation shaft portion 305*a* is engageable with the coupling member 306. The other and 305*e* is engageable with a stopper member (second bearing member) in the second receiving portion 301*b*2 of the main body 301A of the toner supply container. The coupling member 306 and the stopper member are rotatably supported on the main body 301A of the container through the bearing member 308. Six supporting as 305*b* (305*b*1–305*b*6) are extended substantially perpendicularly from the rotation shaft portion 305*a*, and proper roundings are provided at the connecting portions between the rotation shaft portion 305*a* and the supporting arms 305*b* to enhance the strength of the stirring rotation member 305, in view of a possibility that toner is caked with the result of increased stirring resistance. In this embodiment, R2 is provided at each of the connecting portions between the rotation shaft portion 305*a* and the supporting arms 305*b*.

The supporting arm 305*b* and the supporting arm 305*b* are each in the form of a flat plate and are extended substantially perpendicularly from the rotation shaft portion 305*a*, and in this embodiment, it has a width 305*b*L5 (FIG. 9) of approx. 12 mm and a height of approx. 39.4 mm from the axis of the shaft portion 305*a*. Such supporting arms 305*b* (305*b*1–305*b*6) are provided at six positions, respectively. The thickness 305*b*L4 (FIG. 9) of the supporting arm 305*b* is preferably 1 mm–3 mm, and is approx. 2 mm. Such supporting arms 305*b* are provided at six positions, respectively. More particularly, in addition to two Supporting arms 305*b*1, 305*b*3 and 305*b*4, 305*b*6 supporting the opposite axial end portions of the horizontal portion 305*c*2 (crossing portion), there are provided supporting arms 305*b*2, 305*b*5 supporting the horizontal portion 305*c*2 at substantially central portions with respect to the axial direction. Connecting portions between the supporting arms 305*b*2, 305*b*5 and the bridging portion 305*c* have narrowed free ends so as to meet a length L1 of the horizontal portion 305*c*2 of the bridging portion 305*c*. A distance between the center of the rotation shaft portion 305*a* and the free end of the supporting arm 305*b* is properly determined in accordance with the size of the main body 301A of the container, but generally it is preferably 70%–95% of an inner radius of the main body 301A of the container. In this embodiment, the inner diameter of the main body 301A of the container is approx. 44.5 mm, and the length is approx. 39.4 mm (69%).

The bridging portion 305*c* and the bridging portion 305*c* are constituted by two portions are staggeredly arranged to provide a phase difference of approx. 180° substantially at the central portion with respect to the axial direction. Total lengths of the bridging portions 305*c* measured in the axial direction are approx. 180 mm, and the bridging portions 305*c* are spaced apart from the rotation shaft portion 305*a* by 39.4 mm correspondingly to the height of the supporting arm 305*b*. The bridging portion 305*c* includes a horizontal portion 305*c*2 extending substantially parallel with a moving direction of the stirring rotation member 305 and a inclined surface portion 305*c*1 provided downstream of the bridging portion 305*c*.

The inclined surface portion 305*c*1 a inclined surface portion 305*c*1 arm provided downstream of the bridging portion 305*c* with respect to the rotational direction. The inclined surface portion 305*c*1 is provided with eight projection integral with each of the inclined surface portion 305*c*1 to securedly support tie flexible member 313. The inclined surface portion 305*c*1 has such a configuration such that width of the inclined surface portion 305*c*1 at the position where the projections are provided and that at the position where the projections are provided are different from each other, more particularly, the former is larger. In this embodiment, the larger one is approx. 8 mm, and the shorter one is approx. 5 mm. An angle θ of the inclined surface portion 305*c*1 relative to the moving direction of the bridging portion 305*c* (an angle formed between a direction α of overhanging extension of the flexible member and a tangential direction indicated in FIG. 9, (c)) is preferably 30°–60°, and in this embodiment, θ=45° (FIG. 9). In the toner supply container 301 in this embodiment, the rubbing force with which the inner wall surface of the container accommodating portion is too small if the angle θ is smaller than 30° with the result of increase of the remaining toner mount, and it the angle θ is larger than 60°, the rubbing force is too strong with the result of increased stress applied to the toner, which leads to production of large particles of the toner, and therefore, to increase of the stirring torque.

The horizontal portion 305*c*2 and the horizontal portion 305*c*2 are integral to each other and are provided upstream of the bridging portion 305*c* with respect to the rotational direction, extending substantially parallel with the moving direction. In this embodiment, the length of the horizontal portion 305*c*2 (bridging portion 305*c*), measured in the moving direction (tangential direction of the circumferential movement, upward in FIG. 9, (d)) of the horizontal portion 305*c*2 adjacent the connecting portion between the bridging portion 305*c* and the supporting arm 305*b*, at each of the opposite longitudinal end portion of the bridging portion 805*c*, is L3, and the length measured in the same direction at a position away from said connecting portion is L1. More particularly, L1 is the length between the central line extending left-right direction and the bottom line in FIG. 9, (d), as shown in this Figure, and L3 in the length measured in the same direction at the left and right end positions. In this embodiment, L3 is approx. 10 mm, L1 is approx. 6 mm. The horizontal portion 305*c*2 is connected with the supporting arms 305*b*2, 305*b*5 at the central portion with respect to the axial direction, but the lengths are rather arbitrary, and the lengths in the widthwise direction may be L1 or L3.

The foregoing embodiment is summarized as follows:

(1) when the flexible member is not flexed, the bridging portion has an inclined surface portion which is contacted to the flexible member which is parallel with the direction of overhanging portion of the flexible member, and has a horizontal portion (substantially circumferentially extending portion) extending in a direction crossing with the overhanging direction.

(2) on the other hand, when the flexible member flexes inwardly toward the downstream direction (when the flexible member is bent to the maximum extent without existence of the toner between the bridging portion and the flexible member), the bridging portion has a contact portion (above the supporting arm with respect to a direction indicated by "gamma" (along the axis of the shaft)) which is contacted to the flexible member, and a non-contact portion (adjacent the contact portion) which is not contacted with the flexible member. By this, the strength of the rotational stirring member is assured by not deteriorating the strength of the connecting portion relative to the supporting arm, thus avoiding damage of the connecting portion between the bridging portion and the supporting arm. In addition, the horizontal portion has a portion in the form of a cutaway portion between the supporting arms, thus minimizing the accumulation or agglomeration of the toner sandwiched between the flexible member and the horizontal portion, and therefore, decreasing the stirring torque.

Accordingly, the strength of the rotational stirring member is assured so as to endure the stirring resistances, and simultaneously, the stirring torque required to rotate the stirring member is decreased.

For example, from the standpoint of enhancing the strength, it is preferably L3 (10 mm), and from the standpoint of decreasing the torque, it is preferably L1 (6 mm). In this embodiment, the length of the connecting portion substantially at the central portion of the horizontal portion 305*c*2, measured along the short side, is 6 mm which in the same as the length L1.

The description will be made as to the flexible member 313.

The flexible member 313 in made of a material having a low rigidity, for example, PET (polyethylene terephthatlate), PE (polyethylene), PP (polypropylene), IPP (polyphenylenesulfide resin material) sheet or the like. The thickness of the flexible member 313 is preferably approx. 50 μm–500 μm–500 μm, and further preferably 100 μm–300 μm. In the embodiment, the flexible member 313 is a polyester sheet having a thickness of approx. 100 μm.

In this embodiment, the flexible member 313 has a length which is larger than the distance from a free end of the rigid member blade portion to the inner wall surface of the container with respect to the circumference wall surface substantially parallel with the rotational axis. A length of a free end from the end of the inclined surface portion 305*c*1 is L2 which is 15 mm in this embodiment.

In this embodiment, all of the flexible members 313 are fixed on the inclined surface portion 305*c*1 by one crimping action. Other fixing method is usable, such as riveting, double coated tape or the like, or It may be integrally molded with the bridging portion 305*c*. Toner discharging test has been carried out with the toner supply container 301 having the above-described structures. The toner discharging test was carried out, 1650 g of toner (one component black toner which has positive charging property and which is for GP605 process cartridge available from Cannon Kabushiki Kaisha had ben filled into the container, and the container has been subjected to a tapping process using a tapping machine.

The result of the test has shown that rotational stirring torque required for the stirring rotation at the initial stage is reduced by approx. 20% as compared with a toner supply container not using the present invention, that is, as compared with the container in which the length measured in the tangential direction of the motion of the horizontal portion 305*c*2 is constant (approx. 10 mm) in the longitudinal direction thereof, under the common conditions in which L1=L3=approx. 10 mm L2=15 mm at the horizontal portion 305*c*2 of the bridging portion 305*c*.

FIG. 15 shows a stirring rotation member 305 having lengths L1=L2=approx. 10 mm and L3=15 mm. FIG. 15 is a front view of the stirring rotation member 305 (a), a top plan view thereof (b), a side view thereof (c), a top plan view of a horizontal portion 305*c*2, a side view of supporting arms 305*b*2, 305*b*5 disposed at the central portion of the bridging portion 305*c*.

As regards the blade strength, the rotational stirring blade having lengths L1=L3=approx. 10 mm is durable against the rotational stirring torque of 35–40 kgf.cm without damage or blanching, and the rotational stirring blade having the structure of this embodiment having the lengths L1=approx. 10 mm and L3=approx. 6 mm is durable against the rotational stirring torque of 35–40 kgf.cm without damage or blanching.

Figure 16:
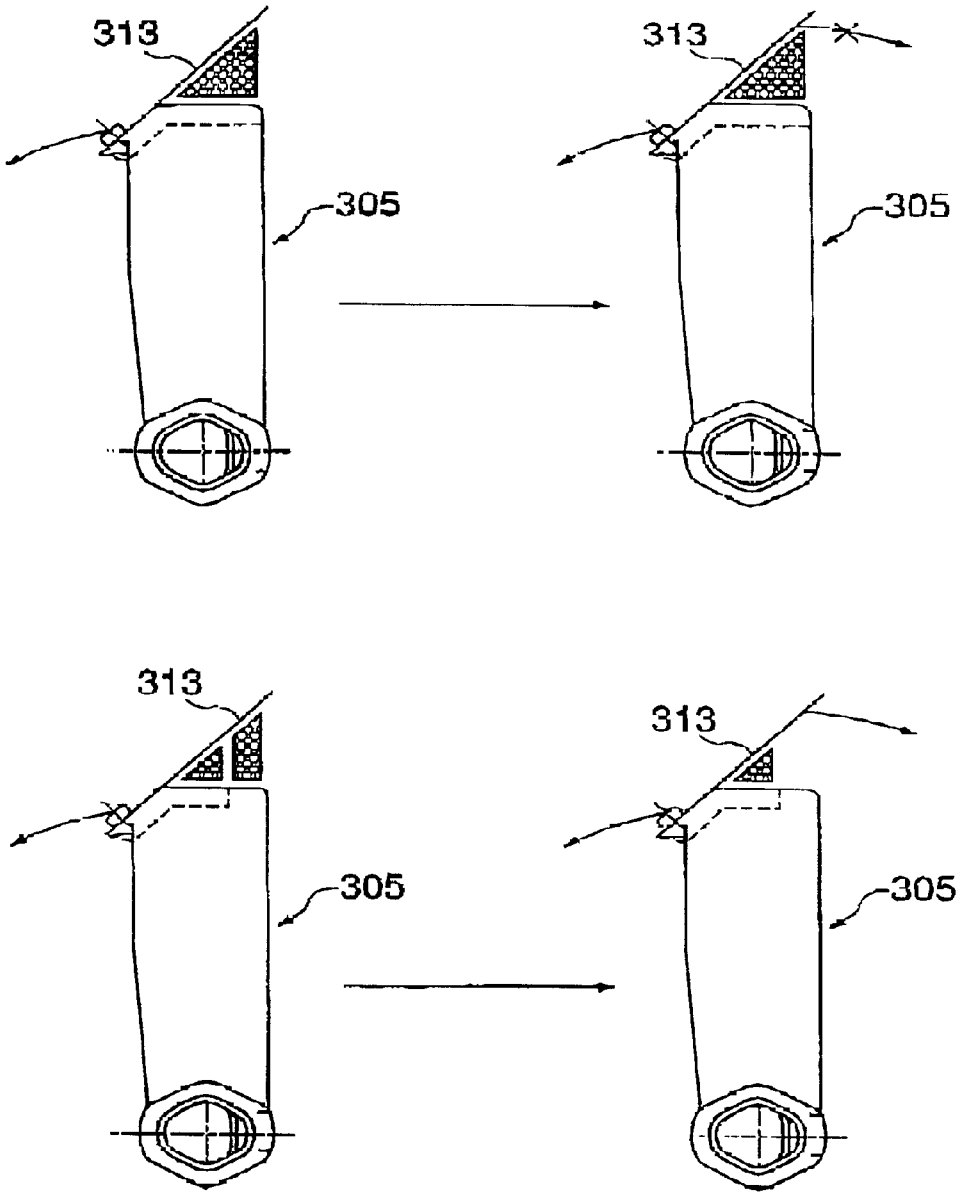
FIG. 16 illustrates a mechanism by which the rotational stirring torque of the stirring rotation member having dimensions of L1=approx. 10 mm, L3=approx 6 mm and L2=15 mm decreases as compared with a stirring rotation member having dimensions of L1=L3=approx. 10 mm and L2=15 mm.

Referring to FIG. 16, the description will be made as to a mechanism for reduction of the rotational stirring torque.

As shown in FIG. 16, when L1=L3=10 mm and L2=15 mm, the situation is like this. Even when the stirring rotation of the stirring rotation member 305 begins, an agglomeration of the toner accumulated behind the flexible member 313 is kept accumulated, and therefore, the flexible member 313 is either unable to or hardly does flex. On the other hand, in the case of FIG. 16, in which L1=6 mm, L3=10 mm and L2=15 mm, when the stirring rotation of the stirring rotation member 305 begins, an agglomeration of the toner accumulated behind the flexible member 313 disappears, and therefore, the flexible member 313 is able to flex. As a result, the projected area of the stirring rotation member 305 relatively to the toner decreases, and therefore, the rotational stirring torque can be reduced.

<Embodiment 2>

The description will be made as to Embodiment 2 of the present invention. Since the structures of this embodiment are the same as with Embodiment 1, the detailed description will be made as to the configurations of the rotation shaft portion 325*a,* the supporting arm 325*b* and the bridging portion 325*c* of the stirring rotation member 325.

Figure 12:
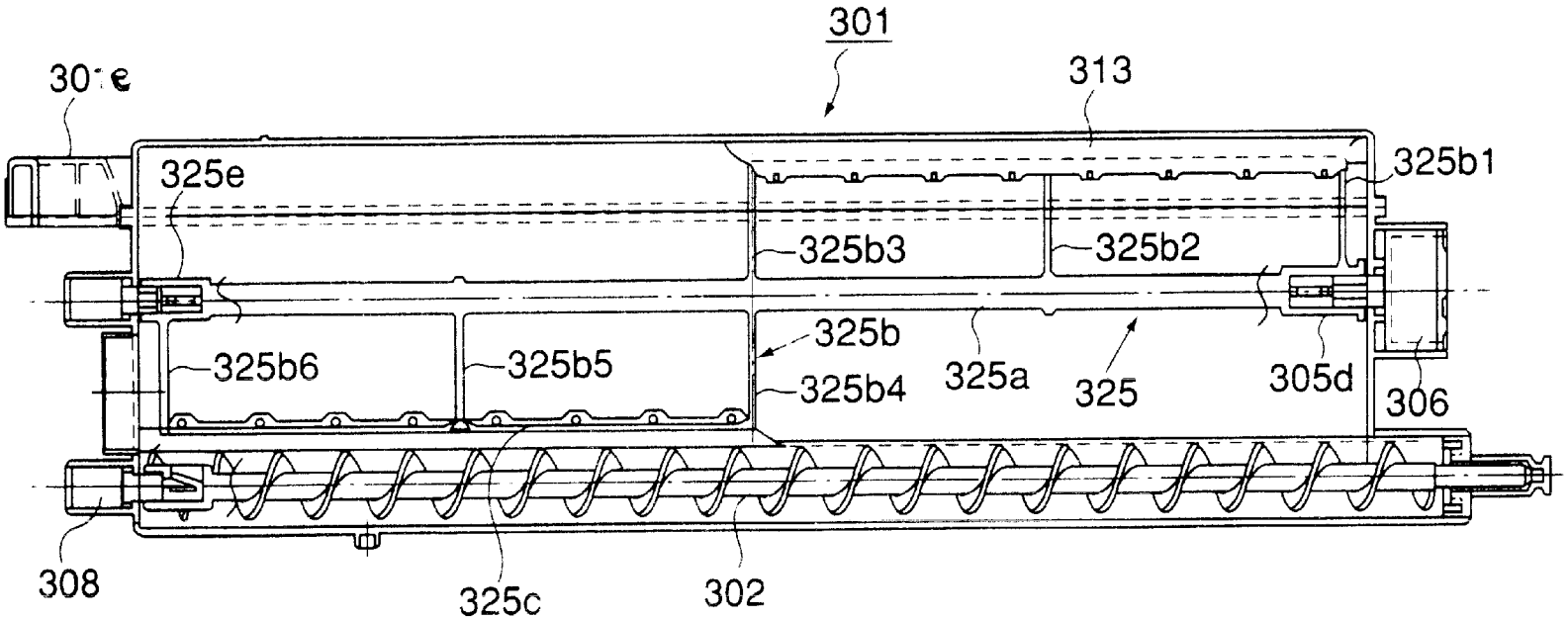
FIG. 12 is a front sectional view of a toner supply container provided with a stirring rotation member according to Embodiment 1 of the present invention.

FIG. 11 is a front view of the stirring rotation member 325 (a), a top plan view thereof (b), a side view thereof (e), a top plan view of the horizontal portion 325*c*2 (d), a side view of the supporting arms 325*h*2, 325*b*5 and supporting arm 325*b*2, 325*b*5 (e); and FIG. 12 is a sectional front view of a toner supply container 301 provided with the stirring rotation member 325.

As shown in FIG. 12, the stirring rotation member 325 includes a rotation shaft portion 325*a*, supporting as 325*b*, bridging portions 325*c* and flexible arms 313. The rotation shaft portion 325*a*, the supporting arms 325*b* and the bridging portion 325*c* are produced through injection molding from a plastic resin material having a relatively high rigidity, whereas the flexible member 313 has a relatively low rigidity material (for example, plastic resin material film or sheet, an elastomer sheet or the like). In this embodiment, the flexible member 313 is made of a polyester sheet.

It is preferable that rotation shaft portion 325*a*, the supporting arms 325*b* and the bridging portion 325*c* are preferably produced integrally from a relatively high rigidity plastic resin material through an injection molding, but may be produced by connecting a plurality of parts by welding, bonding or the like into an integral member. In the embodiment, the use is made with an ABS resin material which is integrally molded through an injection molding.

The description will be made as to the configurations of the rotation shaft portion 325*a*, the supporting arm 325*b* and the bridging portion 325*c* according to one of the features of the present invention.

The rotation shaft portion 325*a* and the rotation shaft portion 325*a* are each in the form of a rod having a diameter of 9 mm, and one end 305*d* thereof is engageable with the coupling member 306. The other end 325*e* in engageable with a stopper member (second bearing member) in the second receiving portion 301*b*2 of the main body 301A of the toner supply container. The coupling member 306 and the stopper member are rotatably supported on the main body 301A of the constrainer through the bearing member 308. Six supporting arms 305*b* (305*b*1–305*b*6) are tended substantially perpendicularly from the rotation shaft portion 305*a*, and proper roundings are provided at the connecting portions between the rotation shaft portion 305*a* and the supporting arms 305*b* to enhance the strength of the stirring rotation member 305. In this embodiment, R2 is provided at each of the connecting portions between the rotation shaft portion 325*a* and the supporting arms 325*b*.

The supporting arm 325*b* and the supporting arm 325*b* are each in the form of a flat plate and are extended substantially perpendicularly from the rotation shaft portion 325*a,* and in this embodiment, it has a width 325*b*L5 (FIG. 11) of approx. 12 mm and a height of approx. 39.4 mm from the axis of the shaft portion 325*a*. Such supporting arms 325*b* (325*b*1–325*b*6) are provided at six positions, respectively. The thickness 325*b*L4 (FIG. 11) of the supporting arm 325*b* is preferably 1 mm–3 mm, and is approx. 2 mm. Such supporting arms 325*b* (325*b*1–325*b*6) are provided at six positions, respectively. More particularly, in addition to two supporting arm 325*b*1, 325*b*3 and 325*b*4, 325*b*6 supporting the opposite axial end portions of the horizontal portion 325*c*2, there are provided supporting arm 325*b*2, 325*b*5 supporting the horizontal portion 325*c*2 at substantially central portions with respect to the axial direction. A distance between the center of the rotation shaft portion 325*a* and the free end of the supporting arm 325*b* is properly determined in accordance with the size of the main body 301A of the container, but generally it is preferably 70%–95% of an inner radius of the main body 301A of the container. In this embodiment, the inner diameter of the main body 301A of the container is approx. 44.5 mm, and the length is approx. 39.4 mm (89%).

The bridging portion 325*c* and the bridging portion 325*c* are constituted by two portions and are staggeredly arranged to provide a phase difference of approx. 180° substantially at the central portion with respect to the axial direction. Total lengths of the bridging portion 325*c* measured in the axial direction are approx. 180 mm, and the bridging portion 325*c* are spaced apart from the rotation shaft portion 325*a* by 39.4 mm correspondingly to the height of the supporting arms

325*b*2 and 325*b*5. The bridging portion 325*c* includes a horizontal portion 325*c*2 extending substantially parallel with a moving direction of the stirring rotation member 325 and an inclined surface portion 325*c*1 provided downstream of the bridging portion 325*c*.

The inclined surface portion 315*c*1 and inclined surface portion 325*c*1 are provided downstream of the bridging portion 325*c* with respect to the rotational direction. The inclined surface portion 325*c*1 is provided with eight projection integral with each of the inclined surface portion 325*c*1 to securedly support the flexible member 313. The inclined surface portion 325*c*1 has such a configuration such that width of the inclined surface portion 325*c*1 at the position where the projections are provided and that at the position where the projections are provided are different from each other, more particularly, the former is larger. In this embodiment, the larger one is approx. 8 mm, and the shorter one is approx. 5 mm. An angle θ of the inclined surface portion 325*c*1 relative to the moving direction of the bridging portion 325*c* is preferably 30°–60°, and in this embodiment, θ=45°.

The horizontal portion 325*c*2 and the horizontal portion 325*c*2 are integral to each other and are provided upstream of the bridging portion 325*c* with respect to the rotational direction, extending substantially parallel with the moving direction. In this embodiment, the length of the horizontal portion 325*c*2 (bridging operation 325*c*), measured in the moving direction (tangential direction of the circumferential movement, upward in FIG. 11, (d)) of the horizontal portion 325*c*2 adjacent the connecting portion between the bridging portion 325*c* and the supporting arm 325*b*, at each of the opposite longitudinal end portion of the bridging portion 325*c*, is L3, and the length measured in the same direction at a position away from said connecting portion is L1. More particularly, L1 is the length between the central line extending left-right direction and the bottom line in FIG. 11, (d), as shown in this Figure, and L3 is the length measured in the same direction at the left and right end positions. In this embodiment, L1 is approx. 6 mm, L3 is approx. 10 mm. The horizontal portion 325*c*2 is connected with the supporting arm 325*b*2, 325*b*5 at the central portion with respect to the axial direction, but the lengths are rather arbitrary, and the lengths in the widthwise direction may be L1 or L2. In this embodiment, the length of the connecting portion substantially at the central portion of the horizontal portion 325*c*2, measured along the short side, is 10 mm which is the same as the length L3.

The flexible member 313 is similar to that of Embodiment 1, and therefore, the detailed description thereof is omitted for simplicity. A length L2 of free portion of the flexible ember 313 from the end of the inclined surface portion 325*c*1 is 15 mm.

Toner discharging test has been carried out with the toner supply container 301 having the above-described structures. The toner discharging test wan carried out. 1650 g of toner (one component black toner which has positive charging property and which is for GP605 process cartridge available from Canon Kabushiki Kaisha had ben filled into the container, and the container had been subjected to a tapping process using a tapping machine.

The results of the toner discharging test has shown that rotational stirring torque required for the stirring rotation at the initial stage is reduced by approx. 20% as compared with a toner supply container not using the present invention, that is, as compared with the container in which the length measured in the tangential direction of the motion of the horizontal portion 305*c*2 is constant (approx. 10 mm) in the longitudinal direction thereof, under the common conditions in which L1=L3=approx. 10 mm and L2=15 mm at the horizontal portion 305*c*2 of the bridging portion 305*c*.

As regards the blade strength, the rotational stirring blade having lengths L1=L3=approx. 10 mm and L=approx. 15 mm is durable against the rotational stirring torque of 35–40 kgf.cm without damage or blanching, and the rotational stirring blade having the structure of this embodiment having the lengths L1=approx. 6 mm. L3=approx. 10 mm and L2=approx. 15 mm is durable against the rotational stirring torque of 35–40 kgf.cm without damage or blanching.

<Embodiment 3>

The description will be made as to Embodiment 3. Since the structures other than the stirring rotation member are the same as Embodiment 1, the description will be made as to the shapes of the rotation shaft portion 335*a*, the supporting arm 335*b* and the bridging portion 335*c* of the stirring rotation member 335.

Figures 13A, 13B, 13C, 13D:
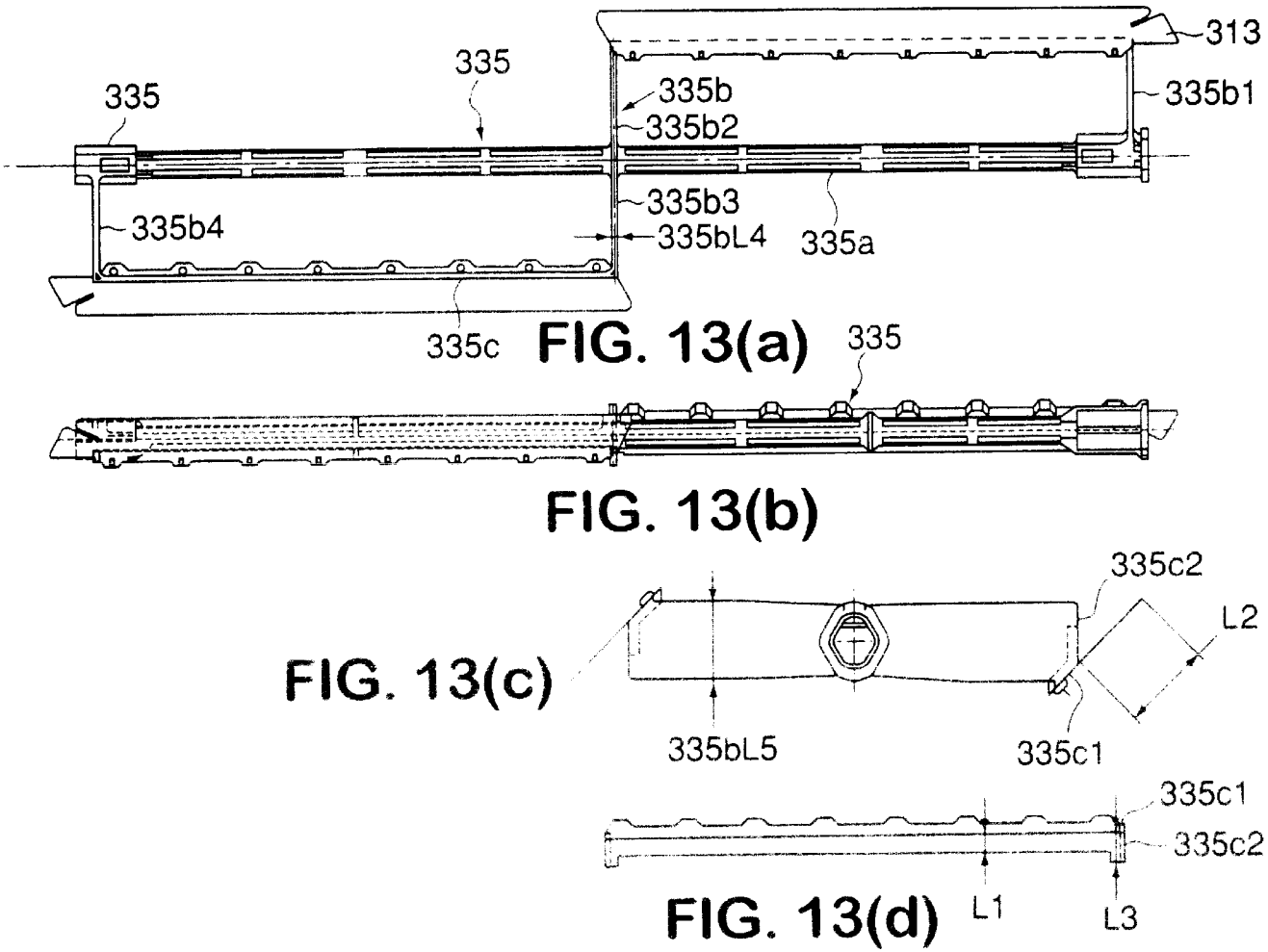
FIG. 13(*a*) is a front view of a stirring rotation member according to Embodiment 3 of the present invention, FIG. 13(*b*) a top plan view of the same, FIG. 13(*c*) is a side view of the same, and FIG. 13(*d*) is a top plan view of a horizontal portion of the same.
Figure 14:
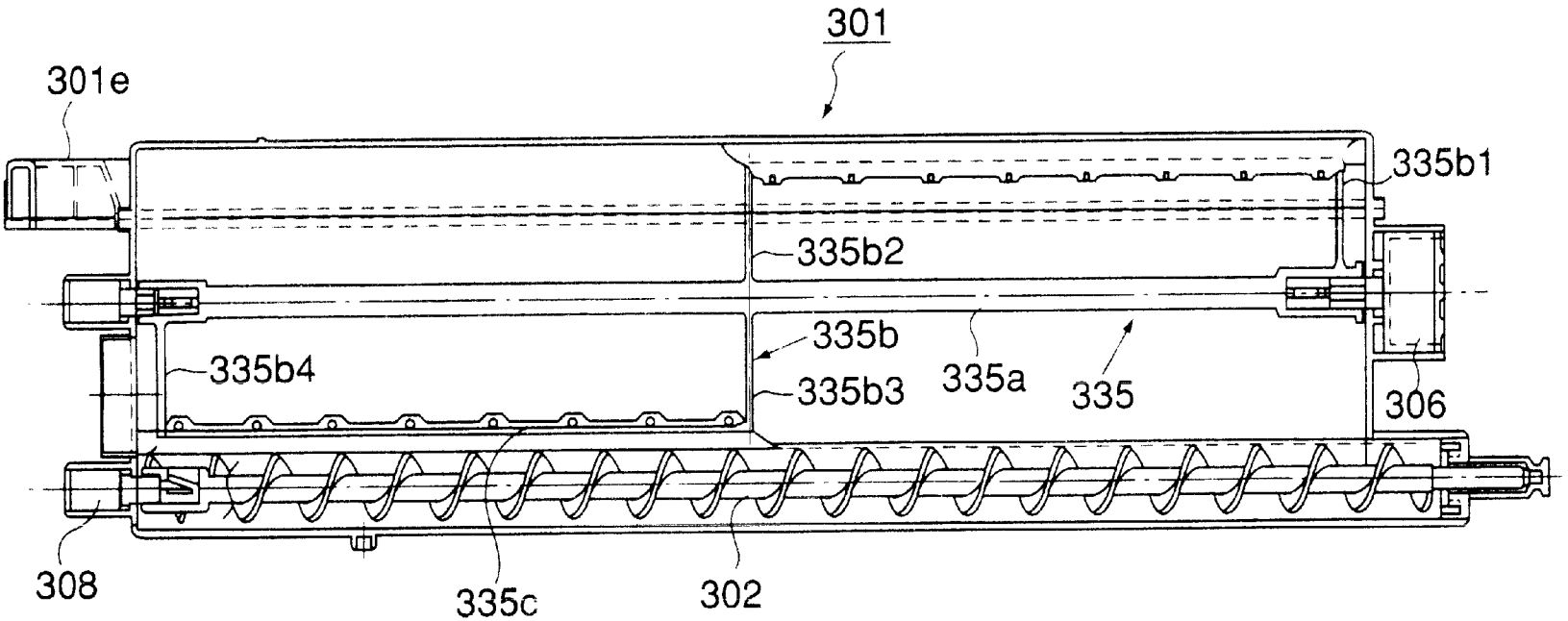
FIG. 14 is a front sectional view of a toner supply container provided with a stirring rotation member according to Embodiment 1 of the present invention.
Figure 15A:
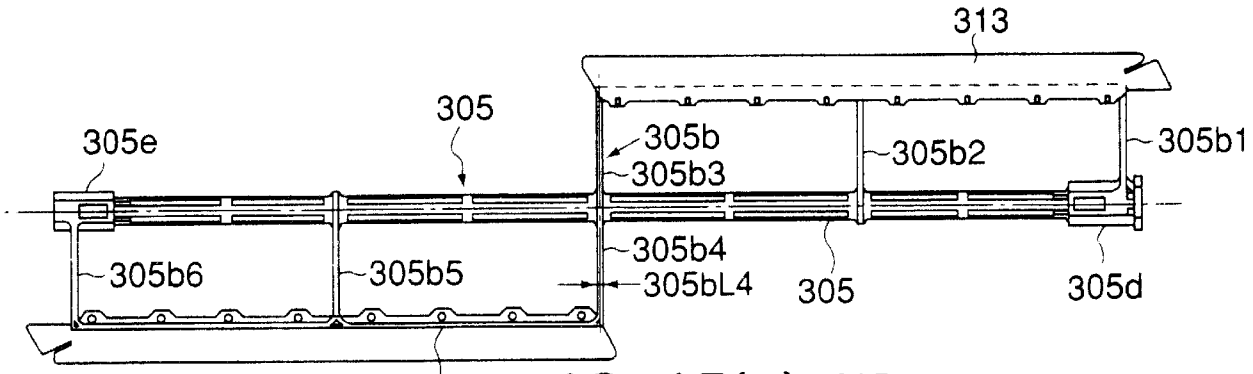
FIG. 15(*a*) is a front view of a stirring rotation member in which L1=L3= is approx. 10 mm, FIG. 15(*b*) is a top plan view of the same, FIG. 15(*c*) is a side view of the same, FIG. 15(*d*) is a top plan view of a horizontal portion of the same, and FIG. 15(*e*) is a side view of a supporting arm.
Figure 15B:
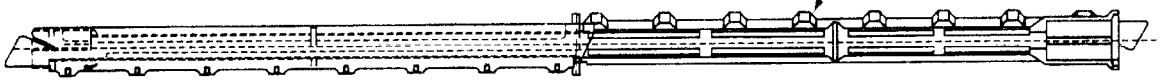
Figure 15C:
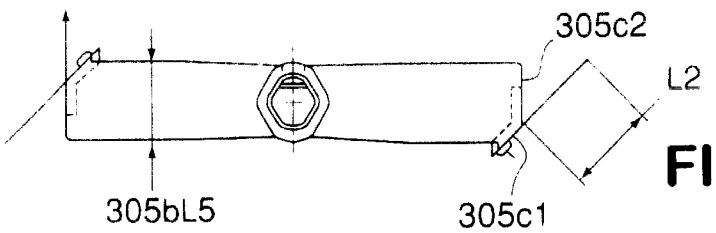
Figure 15D:
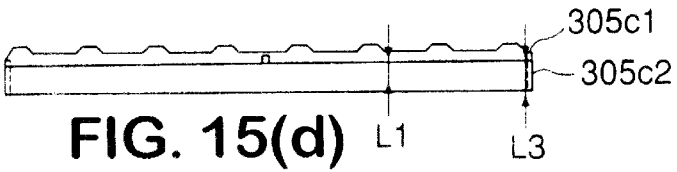
Figure 15E:
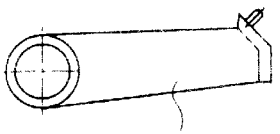

FIG. 13 is a front view of the stirring rotation member 335 (a), a top plan view thereof (b), a side view thereof (c), and a top plan view of the horizontal portion 335*c*2 (d) and FIG. 14 is a sectional front view of a toner supply container 301 provided with the stirring rotation member 335.

As shown in FIG. 14, the stirring rotation member 335 includes a rotation shaft portion 335*a,* supporting arms 335*b,* bridging portions 335*c* and flexible members 313. The rotation shaft portion 335 a, the supporting arms 335*b* and the bridging portion 335*c* are produced through injection molding from a plastic resin material having a relatively high rigidity, whereas the flexible member 313 has a relatively low rigidity material (for example, plastic resin material film or sheet, an elastomer sheet or the like). In this embodiment, the flexible member 313 is made of a polyester sheet.

It is preferable that rotation shaft portion 335*a,* the supporting arms 335*b* and the bridging portion 335*c* are preferably produced integrally from a relatively high rigidity plastic resin material through an injection molding, but may be produced by connecting a plurality of parts by welding, bonding or the like into an integral member. In the embodiment, the use is made with an ABS resin material which is integrally molded through an injection molding.

A description will now be made as to the configurations of the rotation shaft portion 335*a,* the supporting arm 335*b* and the bridging portion 335*c* according to one of the features of the present invention.

The rotation shaft portion 335 an and the rotation shaft portion 335 an are each in the form of a rod having a diameter of 9 mm, and one end 305*d* thereof is engageable with the coupling member 306. The other end 335*e* is engageable with a stopper member (second bearing member) in the second receiving portion 301*b*2 of the main body 301A of the toner supply container. The coupling member 306 and the stopper member are rotatably supported on the main body 301A of the container through the hearing member 308. Four supporting arms 335*b* (335*b*1–335*b*4) are extended substantially perpendicularly from the rotation shaft portion 335*a*, and proper roundings are provided at the connecting portions between the rotation shaft portion 335*a* and the supporting arms 335*b* to enhance the strength of the stirring rotation member 335. In this embodiment, R2 is provided at each of the connecting portions between the rotation shaft portion 325*a* and the supporting arms 325*b*.

The supporting arm 335*b* and the supporting arm 335*b* are each in the form of a flat plate and are extended substantially perpendicularly from the rotation shaft portion 335*a,* and in this embodiment, it has a width 335*b*L5 (FIG. 13) of approx.

12 mm and a height of approx. 39.4 mm from the axis of the shaft portion 335*a*. Such supporting arms 335*a* (335*b*1–335*b*4) are provided at six positions, respectively. The thickness 335*b*L4 (FIG. 9) of the supporting arm 335*b* is preferably 1 mm–3 mm, and is approx. 2 mm in this embodiment. More particularly, two supporting arms 335*b*1, 335*b*2 and 335*b*3, 335*b*4 are provided to support the opposite end (with respect to the rotational axis) portions of the horizontal portion 335*c*2. A distance between the center of the rotation shaft portion 335*a* and the free end of the supporting arm 335*b* is properly determined in accordance with the size of the main body 301A of the container, but generally it is preferably 70%–95% of an inner radius of the main body 301A of the container. In this embodiment, the inner diameter of the main body 301A of the container is approx. 44.5 mm, and the length is approx. 39.4 mm (89%).

The bridging portion 335*c* and the bridging portion 335*c* are constituted by two portions and are staggeredly arranged to provide a phase difference of approx. 180° substantially at the central portion with respect to the axial direction. Total lengths of the bridging portion 335*c* measured in the axial direction are approx. 180 mm, and the bridging portion 335*c* are spaced apart from the rotation shaft portion 335*a* by 39.4 mm correspondingly to the height of the supporting arms 335*b*1, 335*b*2 and 335*b*3, 335*b*4. The bridging portion 335*c* includes a horizontal portion 335*c*2 extending substantially parallel with a moving direction of the stirring rotation member 335 and an inclined surface portion 335*c*1 provided downstream of the bridging portion 335*c*.

The inclined surface portion 335*c*1 and inclined surface portion 335*c*1 are provided downstream of the bridging portion 335*c* with respect to the rotational direction. The inclined surface portion 335*c*1 is provided with eight projection integral with each of the inclined surface portion 335*c*1 to securedly support the flexible member 313. The inclined surface portion 335*c*1 has such a configuration such that width of the inclined surface portion 335*c*1 at the position where the projections are provided and that at the position where the projections are provided are different from each other, more particularly, the former is larger. In this embodiment, the larger one in approx. 8 mm, and the shorter one is approx. 5 mm. An angle θ of the inclined surface portion 335*c*1 relative to the moving direction of the bridging portion 326*c* is preferably 30°–60°, and in this embodiment, θ45°.

The horizontal portion 335*c*2 and the horizontal portion 335*c*2 are provided upstream of the bridging portion 335*c* with respect to the rotational direction, extending substantially parallel with the moving direction. In this embodiment, the length, measured along the short side, of the neighborhood of the connecting portion of the supporting arm 335*b* at each of the opposite end portions of the horizontal portion 335*c*2 is L3 of this invention and the length measured along the short side or the portion not having the supporting arm 335*b*. In this embodiment L1 is approx. 6 mm, L3 is approx. 10 mm.

The flexible member 313 is similar to that of Embodiment 1, and therefore, the detailed description thereof is omitted for simplicity. A length L2 of free portion of the flexible member 313 from the end of the inclined surface portion 335*c*1 is 15 mm.

Toner discharging test has been carried out with the toner supply container 301 having the above-described structures. The toner discharging test was carried out. 1650 g of toner (one component black toner which has positive charging property and which is for GP605 process cartridge available from Canon Kabushiki Kaisha had been filled into the container, and the container had been subjected to a tapping process using a tapping machine.

The results of the toner discharging test has shown that according to the present invention, the rotational stirring torque required for the stirring rotation at the initial stage is reduced by approx. 20% as compared with a toner supply container not using the present invention, that is, as compared with the container in which the length measured in the tangential direction of the motion of the horizontal portion 305*c*2 is constant (approx. 10 mm) in the longitudinal direction thereof, under the common conditions in which L1=L3=approx. 10 mm L2=15 mm at the horizontal portion 305*c*2 of the bridging portion 305*c*.

As regards the blade strength, the rotational stirring blade having lengths L1=L3=approx. 10 mm and L2=approx. 15 mm is durable against the rotational stirring torque of 20–25 kgf.cm without damage or blanching, and the rotational stirring blade having the structure of this embodiment having the lengths L1=approx. 6 mm, L3=approx. 10 mm and is durable against the rotational stirring torque of 20–25 kgf.cm without damage or blanching.

While the invention has been described with reference to the structures disclosed herein, it is not confirmed to the details set forth and this application intended to cover such modifications or changes as may come within the purpose of the improvements or the scope of the following claims.

What is claimed is:

1. A developer supply container for supplying a developer to an image forming apparatus, said developer supply container comprising:

a developer container for accommodating a developer;

a flexible member for stirring the developer in said developer container; and a supporting portion, connected to a rotation shaft, for fixedly supporting said flexible member, wherein said supporting portion includes a contact portion, which is contacted to said flexible member when said flexible member flexes during a stirring operation, and a noncontact portion, which is not contacted to said flexible member when said flexible member flexes during the stirring operation, said noncontact portion being adjacent to said contact portion with respect to an axial direction of said rotation shaft, and wherein said noncontact portion is of a length, which is longer than a length of said contact portion measured in the axial direction.

2. A developer supply container according to claim 1, wherein said supporting portion includes a parallel portion, which is parallel with an overhanging direction of said flexible member and is contacted to said flexible member when said flexible member is flexed, and a crossing portion, which crosses with the overhanging direction and is not contacted to said flexible member when said flexible member is not flexed, wherein said crossing portion includes said contact portion and said noncontact portion.

3. A developer supply container according to claim 2, wherein an angle θ formed between the overhanging direction and a tangential direction satisfies:

$$30° \leqq \theta \leqq 60°.$$

4. A developer supply container according to claim 2, wherein a length of the said noncontact portion is shorter than a length of said contact portion as measured in a crossing direction of said crossing portion.

5. A developer supply container according to claim 4, wherein a length L1 of said noncontact portion and a length L2 of an extension from said crossing portion of said flexible member, satisfy the following conditions:

$$0.2 \times L2 < L1 < 0.6 \times L2.$$

6. A developer supply container according to claim 1, wherein said flexible member is contactable to an inner surface of said developer container.

7. A developer supply container according to claim 1, wherein said developer supply container is detachably mountable to the image forming apparatus.

8. A stirring member for stirring a developer in a developer container by rotation thereof, said stirring member comprising:

a flexible member;

a rotation shaft; and a supporting portion, connected with said rotation shaft, for fixedly supporting said flexible member, wherein said supporting portion includes a contact portion, which is contacted to said flexible member when said flexible member flexes during a stirring operation and a noncontact portion, which does not contact said flexible member when said flexible member flexes during the stirring operation, said noncontact portion being adjacent to said contact portion with respect to a direction of an axis of said rotation shaft, and wherein said noncontact portion is of a length, which is longer than a length of said contact portion measured in the direction.

9. A stirring member according to claim 8, wherein said supporting portion includes a parallel portion, which is parallel with an overhanging direction of said flexible member and is contacted to said flexible member when said flexible member is flexed, and a crossing portion, which crosses with the overhanging direction and is not contacted to said flexible member when said flexible member is not flexed, wherein said crossing portion includes said contact portion and said noncontact portion.

10. A stirring member according to claim 9, wherein an angle θ formed between the overhanging direction and a tangential direction satisfies the following conditions:

$$30° \leqq \theta \leqq 60°.$$

11. A stirring member according to claim 9, wherein a length of said noncontact portion is shorter than a length of said contact portion measured in a crossing direction of said crossing portion.

12. A stirring member according to claim 11, wherein a length L1 of said noncontact portion and a length L2 of an extension from said crossing portion of said flexible member, satisfy the following conditions:

$$0.2 \times L2 < L1 < 0.6 \times L2.$$

13. A stirring member according to claim 8, wherein said flexible member is contactable to an inner surface of said developer container.

* * * * *

UNITED STATES PATENT AND TRADEMARK OFFICE

CERTIFICATE OF CORRECTION

PATENT NO. : 6,704,533 B2
DATED : March 9, 2004
INVENTOR(S) : Tetsuo Isomura et al.

It is certified that error appears in the above-identified patent and that said Letters Patent is hereby corrected as shown below:

Title page,
Item [57], ABSTRACT,
Line 4, "container" should read -- container; --;
Line 7, "or" should read -- of --; and
Line 13, "it" should read -- its --.

Column 1,
Line 17, "it" should read -- is --.

Column 2,
Line 10, "is a" should read --is--; Line 23, "of officer" should read --object--; Line 24, "intention" should read --invention--; and Line 50, "shown" should read --as shown--.

Column 3:
Line 10, "same," should read -- same, and --;
Line 19, "and a" should read -- is a --; and
Line 40, "L3=approx" should read -- L3=approx. --.

Column 4,
Line 18, "an" should read -- on --;
Line 41, "200" should read -- 202 --;
Line 58, "tho" should read -- the --; and
Line 62, "cleaner" should read -- cleaning --.

Column 5,
Line 33, "described" should read -- described. --; and "pro." should read -- per- --;
Line 37, "(d)" should read -- (d), --;
Line 51, "301A" should read -- 301A1 --;
Line 53, "supply" should read -- supplying --; and
Line 59, "301bl. For" should read -- 301bI for --.

Column 6,
Line 10, "in" should read -- is --; and "wit" should read -- with --;
Line 16, "301bl" should read -- 301A --;
Line 28, "common" should read -- amount --;
Line 37, "position" should read -- positioned --;
Line 41, "circular" should read -- the circular --;
Line 45, "partitioning" should read -- positioning --;
Line 48, "to" should read -- the --;
Line 52, "is" should read -- it --; and
Line 67, "resin material" should be deleted.

UNITED STATES PATENT AND TRADEMARK OFFICE

CERTIFICATE OF CORRECTION

PATENT NO. : 6,704,533 B2
DATED : March 9, 2004
INVENTOR(S) : Tetsuo Isomura et al.

It is certified that error appears in the above-identified patent and that said Letters Patent is hereby corrected as shown below:

Column 7,
Line 12, "Includes" should read -- includes --;
Line 19, "comprises" should read -- comprise --; and
Lines 48 through 54 should be deleted.

Column 8,
Line 1, "303D" should read -- 303b --;
Line 3, "301" should read -- 301, --;
Line 6, "or" should read -- of --;
Line 11, "302c" should read -- 303c --;
Line 24, "a" should read -- an --;
Line 46, "shaft" should read -- shaft, --; and
Line 60, "Therefor," should read -- Therefore, --.

Column 9,
Line 3, "the," should read -- the --;
Line 13, "100 of" should read -- 100 of the --;
Lines 19, "or" should read -- or the --;
Line 28, “or” should read -- of the --;
Line 42, "ride" should read -- side --;
Line 45, "looking" should read -- locking --; and
Line 56, "apparatus," should read -- apparatus; --.

Column 10,
Line 3, "(c)" should read -- (c), --; and "(d)" should read -- (d), --;
Line 4, "arms," should read -- arms --; and "(e);" should read -- (e); and --.
Line 8, "shaft)" should read -- shaft), --;
Line 30, "305a. The" should read -- 305a, the --; and
Line 62, "Supporting" should read -- supporting --.

Column 11,
Line 11, "(69%)." should read -- (89%). --;
Line 22, "a" should read -- an --;
Line 25, "a" should read -- and --;
Line 26, "arm" should read -- are --;
Line 29, "jection" should read -- jections--; and
Line 41, "direction" should read --direction β --.

UNITED STATES PATENT AND TRADEMARK OFFICE

CERTIFICATE OF CORRECTION

PATENT NO. : 6,704,533 B2
DATED : March 9, 2004
INVENTOR(S) : Tetsuo Isomura et al.

It is certified that error appears in the above-identified patent and that said Letters Patent is hereby corrected as shown below:

Column 12,
Line 36, "resistances," should read -- resistance, --;
Line 44, "in" should read -- is --;
Line 50, "IPP" should read -- PPS --;
Line 65, "Other" should read -- Another --; and
Line 66, "It" should read -- it --.

Column 13,
Line 6, "ben" should read -- been --;
Line 7, "has" should read -- had --;
Line 36, "FIG. 16," should read -- FIG. 16, (a), --;
Line 42, "FIG. 16," should read -- FIG. 18(b), --;
Line 58, "thereof (e)," should read -- thereof (c), --;
Line 60, "325h2" should read -- 325b2 --;
Line 65, "as" should read -- arms --; and
Line 66, "arms" should read -- members --.

Column 14,
Line 22, "in" should read -- is --;
Line 27, "constainer" should read -- container --; and
Line 28, "tended" should read -- extended --.

Column 15,
Line 5, "315cl" should read -- 325cl --;
Line 10, "jection" should read -- jections --;
Line 51, "ember" should read -- member --;
Line 55, "out. 1650 g" should read -- out, 1650g --; and
Line 58, "ben" should read -- been --.

Column 16,
Line 5, "L=approx." should read -- L2=approx. --;
Line 27, "335 a," should read -- 335a, --;
Line 47, "335 an" should read -- 325a --; and
Line 48, "335 an" should read --335a--.

UNITED STATES PATENT AND TRADEMARK OFFICE

CERTIFICATE OF CORRECTION

PATENT NO. : 6,704,533 B2
DATED : March 9, 2004
INVENTOR(S) : Tetsuo Isomura et al.

It is certified that error appears in the above-identified patent and that said Letters Patent is hereby corrected as shown below:

Column 17,
Line 34, "jection" should read -- jections --;
Line 44, "326c" should read -- 325c --;
Line 45, "θ45°." should read -- θ=45°. --;
Line 53, "invention" should read -- invention, --;
Line 55, "embodiment" should read -- embodiment --; and
Line 64, "out. 1650 g" should read -- out, 1650g --.

Column 18,
Line 22, "confirmed" should read -- confined --; and
Line 23, "intended" should read -- is intended --.

Signed and Sealed this

Twenty-fourth Day of August, 2004

JON W. DUDAS
*Director of the United States Patent and Trademark Office*